US010185236B2

(12) United States Patent
Sugiura et al.

(10) Patent No.: US 10,185,236 B2
(45) Date of Patent: Jan. 22, 2019

(54) IMAGE FORMING APPARATUS AND PROCESS CARTRIDGE

(71) Applicant: FUJI XEROX CO., LTD., Tokyo (JP)

(72) Inventors: Satoya Sugiura, Kanagawa (JP); Shigeru Fukuda, Kanagawa (JP); Hideki Okamoto, Kanagawa (JP); Masahiko Miyamoto, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/244,089

(22) Filed: Aug. 23, 2016

(65) Prior Publication Data

US 2017/0277047 A1 Sep. 28, 2017

(30) Foreign Application Priority Data

Mar. 28, 2016 (JP) ..... 2016-064652

(51) Int. Cl.

*G03G 5/043* (2006.01)
*G03G 21/18* (2006.01)
*G03G 15/16* (2006.01)

(52) U.S. Cl.

CPC ..... *G03G 5/043* (2013.01); *G03G 15/162* (2013.01); *G03G 21/18* (2013.01); *G03G 2215/0132* (2013.01)

(58) Field of Classification Search

CPC ..... G03G 5/0614; G03G 5/0609
See application file for complete search history.

(56) References Cited

U.S. PATENT DOCUMENTS 5,989,765 A * 11/1999 Kobayashi ..... C07C 211/54 430/58.75
9,134,658 B2 9/2015 Matsuura
2002/0191985 A1* 12/2002 Komiya ..... G03G 21/0064 399/149

(Continued)

FOREIGN PATENT DOCUMENTS

JP 2000-147918 * 5/2000 ..... G03G 15/016
JP 2007-108588 A 4/2007
JP 2014-153410 A 8/2014

OTHER PUBLICATIONS

Translation of JP 2000-147918 published May 2000.*

*Primary Examiner* — Peter L Vajda
(74) *Attorney, Agent, or Firm* — Sughrue Mion, PLLC

(57) ABSTRACT

An image forming apparatus includes an electrophotographic photoreceptor having a photosensitive layer that includes at least one of a hindered phenol antioxidant and a benzophenone ultraviolet absorber, a charging device, an electrostatic latent image forming device, a developing device, and a transfer device that includes an intermediate transfer belt whose electric field dependence of a volume resistivity is 0.003 or less (log Ω·cm)/V in a voltage range of from 500 V to 1,000 V, and transfers a toner image formed on a surface of the electrophotographic photoreceptor onto a recording medium through the intermediate transfer belt and erases charges from the surface of the electrophotographic photoreceptor by applying current to the electrophotographic photoreceptor after the toner image formed on the surface of the electrophotographic photoreceptor has been transferred onto the intermediate transfer belt.

19 Claims, 1 Drawing Sheet

(56) References Cited

U.S. PATENT DOCUMENTS

| | | | | |
|---|---|---|---|---|
| 2003/0190540 | A1* | 10/2003 | Shoshi | C07D 209/58<br>430/78 |
| 2006/0014097 | A1* | 1/2006 | Perry | G03G 5/0503<br>430/133 |
| 2009/0162767 | A1* | 6/2009 | Wu | G03G 5/0567<br>430/58.25 |

* cited by examiner

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2016-064652 filed Mar. 28, 2016.

BACKGROUND

1. Technical Field

The present invention relates to an image forming apparatus and a process cartridge.

2. Related Art

In the related art, an apparatus for sequentially performing charging, forming an electrostatic latent image, developing, transferring, cleaning, and the like using an electrophotographic photoreceptor (hereinafter referred to as a "photoreceptor" in some cases) is widely known as an electrophotographic image forming apparatus.

As the electrophotographic photoreceptor, a function-separation type photoreceptor in which a charge generation layer that generates charges and a charge transport layer that transports charges are laminated on an electroconductive substrate such as aluminum, or a single-layer photoreceptor in which a function of generating charges and a function of transporting charges are integrally completed in the same layer is known.

SUMMARY

According to an aspect of the invention, there is provided an image forming apparatus including:

an electrophotographic photoreceptor having an electroconductive substrate and a photosensitive layer that is provided on the electroconductive substrate and includes at least one selected from the group consisting of a hindered phenol antioxidant and a benzophenone ultraviolet absorber;

a charging device that charges a surface of the electrophotographic photoreceptor;

an electrostatic latent image forming device that forms an electrostatic latent image on a charged surface of the electrophotographic photoreceptor;

a developing device that develops the electrostatic latent image formed on the surface of the electrophotographic photoreceptor by a developer including a toner to form a toner image; and a transfer device that includes an intermediate transfer belt whose electric field dependence of a volume resistivity is 0.003 or less (log Ω·cm)/V in a voltage range of from 500 V to 1,000 V, and transfers the toner image formed on the surface of the electrophotographic photoreceptor onto a recording medium through the intermediate transfer belt and erases the charges from the surface of the electrophotographic photoreceptor by applying current to the electrophotographic photoreceptor after the toner image formed on the surface of the electrophotographic photoreceptor has been transferred onto the intermediate transfer belt.

BRIEF DESCRIPTION OF THE DRAWINGS

Exemplary embodiments of the present invention will be described in detail based on the following figures, wherein.

DETAILED DESCRIPTION

Figure 1:
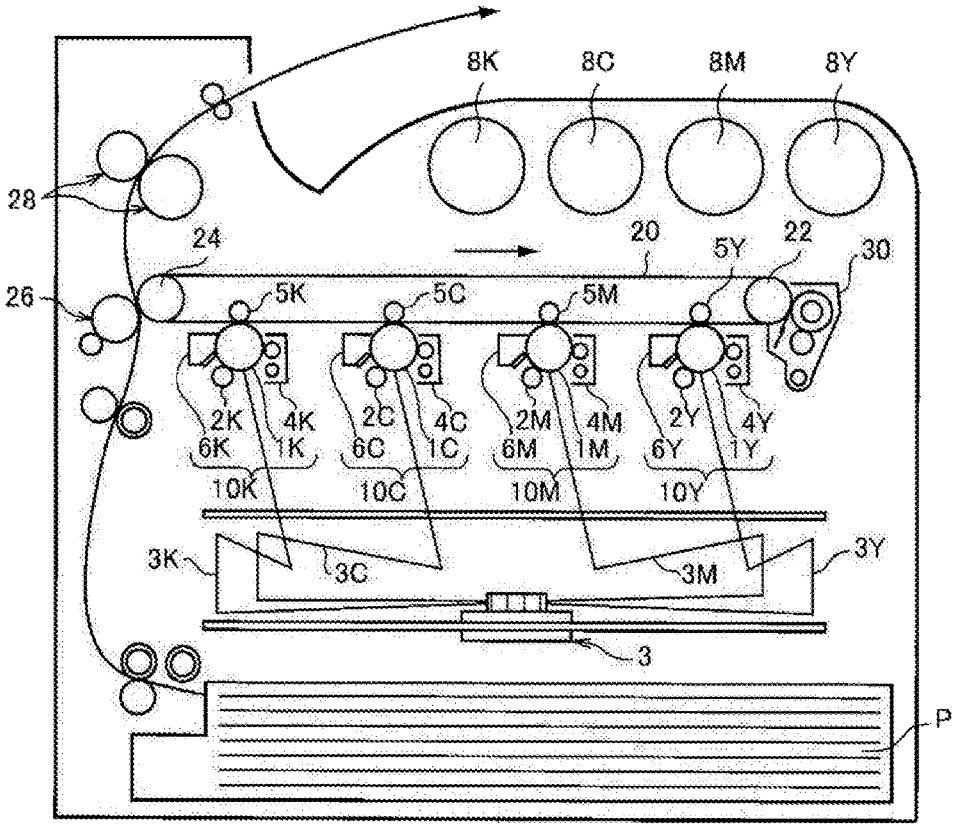
FIG. 1 is a schematic configuration diagram showing one example of the image forming apparatus according to the exemplary embodiment.

Hereinbelow, the exemplary embodiments of the invention will be described with the attached drawings. Further, the same or equivalent symbols are attached to the same elements in the drawings, and duplicate descriptions will be omitted.

Image Forming Apparatus

The image forming apparatus according to the exemplary embodiment includes:

an electrophotographic photoreceptor having an electroconductive substrate and a photosensitive layer that is provided on the electroconductive substrate and includes at least one selected from the group consisting of a hindered phenol antioxidant and a benzophenone ultraviolet absorber, a charging device that charges the surface of the electrophotographic photoreceptor, an electrostatic latent image forming device that forms an electrostatic latent image on a charged surface of the electrophotographic photoreceptor, a developing device that develops the electrostatic latent image formed on the surface of the electrophotographic photoreceptor by a developer including a toner to form a toner image, and a transfer device that includes an intermediate transfer belt whose electric field dependence of a volume resistivity is 0.003 or less (log Ω·cm)/V in a voltage range of 500 V to 1,000 V, and transfers the toner image formed on the surface of the electrophotographic photoreceptor onto a recording medium through the intermediate transfer belt and erases the charges on the surface of the electrophotographic photoreceptor by applying current to the electrophotographic photoreceptor after the toner image formed on the surface of the electrophotographic photoreceptor has been transferred onto the intermediate transfer belt.

By the image forming apparatus according to the exemplary embodiment, occurrence of ghosting is prevented in the case where there is no charge erasing mechanism for an exclusively use and image formation is repeatedly carried out. The reason therefor is presumed as follows.

The image formation by electrophotography requires a process of erasing charges remaining on the surface of a photoreceptor after completion of an image formation cycle in order to prevent occurrence of ghosting. As a method for erasing the residual charges on the surface of the photoreceptor (erasing charges), for example, a method in which a bias with an opposite polarity is applied to the surface of the photoreceptor, and a method in which a photoreceptor is exposed before imaging in the next cycle and the residual charges are removed by generated charges are known. However, in any of the charge erasing methods, a difference in latent image formation in the next cycle remains from the viewpoint that there is a difference in the charge amount between a history area imaged in the former cycle and the inside of the photoreceptor present in an unimagined area, and thus, variation in densities by ghosting easily occurs.

The charges remaining within the photoreceptor of the exposed area in the former cycle are widely distributed in the range from components with low mobility to components with high mobility. Further, since the mobility has electric field dependence, it is necessary to apply a strong electric field in order to release all of the components with low mobility only by applying an electric field for a short period of several tens milliseconds during the formation of an image. In this regard, it is difficult to prevent both of ghosting and transfer failure.

Furthermore, since a transfer member such as an intermediate transfer belt has electric field dependence of volume resistance, the components with low mobility are released more slowly and the components with high mobility are released more fast, whereby the transfer conditions are further restricted. Particularly, in the case of forming an image at a high speed using a toner having a high adhesive force and a small particle diameter, for which a stronger transfer electric field is required, transfer failure is likely to be notably shown.

On the other hand, in the image forming apparatus according to the exemplary embodiment, it is thought that the charges remaining after the transfer are captured by the hindered phenol antioxidant or the benzophenone ultraviolet absorber included in the photosensitive layer of the photoreceptor, and accordingly, the residual charges are reduced. It is also thought that since the intermediate transfer belt for use in the image forming apparatus according to the exemplary embodiment has little electric field dependence, generation of components (charges) with low mobility is prevented. In the image forming apparatus according to the exemplary embodiment as described above, it is thought that occurrence of ghosting is prevented even when a charge erasing mechanism for an exclusively use is not included, by employing a configuration in which the residual charges with high mobility are released by a transfer electric field after generation of the residual charges with low mobility has been prevented.

Hereinafter, one example of the image forming apparatus according to the exemplary embodiment will be described with reference to the drawings. FIG. 1 schematically shows one example of the image forming apparatus according to the exemplary embodiment.

FIG. 1 is a schematic configuration diagram showing one example of the image forming apparatus according to the exemplary embodiment.

The image forming apparatus shown in FIG. 1 has first to fourth electrophotographic image forming units 10Y, 10M, 10C, and 10K that output the images of the respective colors of yellow (Y), magenta (M), cyan (C), and black (K) based on color-separated image data. These image forming units (hereinafter simply referred to as "units" in some cases) 10Y, 10M, 10C, and 10K are disposed in the horizontal direction with given intervals therebetween. Further, these units 10Y, 10M, 10C, and 10K may each be a process cartridge that may be detachably mounted on an image forming apparatus.

Upward of the respective units 10Y, 10M, 10C, and 10K in the drawing, an intermediate transfer belt 20 as an intermediate transfer member extends through the respective units. The intermediate transfer belt 20 is provided to be supported from the inner surface by a driving roller 22 and a back-up roller 24 which contacts with the inner surface of the intermediate transfer belt 20, the driving roller 22 and back-up roller 24 being disposed at positions separated from each other in the direction from the left side to the right side in the drawing, and runs in a direction from the first unit 10Y to the fourth unit 10K. Force is applied to the back-up roller 24 by a spring or the like not shown in a direction departing from the driving roller 22, whereby tension is applied to the intermediate transfer belt 20 supported by both rollers. Furthermore, the intermediate transfer member cleaning device 30 is disposed facing the drive roller 22 on the outer side of the intermediate transfer belt 20.

Incidentally, toners of four colors of yellow, magenta, cyan, and black included in toner cartridges 8Y, 8M, 8C, and 8K, respectively, are supplied to the respective developing devices (developing units) 4Y, 4M, 4C, and 4K of the respective units 10Y, 10M, 10C, and 10K.

The first to fourth units 10Y, 10M, 10C, and 10K have substantially the same configuration. Therefore, herein, the description is given to the first unit 10Y that is disposed at an upstream side in a running direction of the intermediate transfer belt and forms a yellow image, as a representative. To portions identical with the first unit 10Y, in place of yellow (Y), the reference numeral may be attached with magenta (M), cyan (C), or black (K) and, therefore, descriptions of the second to fourth units 10M, 10C, and 10K will be omitted.

The first unit 10Y has a photoreceptor 1Y which acts as an image holding member. Around the photoreceptor 1Y, a charging roller (one example of a charging unit) 2Y that charges the surface of the photoreceptor 1Y with a given electrical potential, an exposure device (one example of an electrostatic charge image forming unit) 3 with which the charged surface is exposed with a laser beam 3Y in accordance with a color-separated image signal to form an electrostatic charge image, a developing device (one example of a developing unit) 4Y that develops the electrostatic charge image by supplying a charged toner to the electrostatic charge image, a primary transfer roller 5Y (one example of a primary transfer device) that transfers the developed toner image onto the intermediate transfer belt 20, and a photoreceptor cleaning device (one example of a cleaning unit) 6Y that removes the toner remaining on the surface of the photoreceptor 1Y after primary transfer, are disposed in order.

Moreover, the primary transfer roller 5Y is disposed inside of the intermediate transfer belt 20 and at a position facing the photoreceptor 1Y. Further, a bias power source (not shown) that applies a primary transfer bias is connected to each of the primary transfer rollers 5Y, 5M, 5C, and 5K. Each bias power source changes a transfer bias to be applied to each primary transfer roller by controlling a control section not shown.

Hereinafter, an operation of the first unit 10Y when a yellow image is formed will be described.

First, prior to an operation, the surface of the photoreceptor 1Y is charged to an electrical potential of −600 V to −800 V using the charging roller 2Y.

The photoreceptor 1Y is formed of an electroconductive substrate (for example, having a volume resistivity at 20° C. of equal to or less than $1\times10^{-6}$ Ωcm) and a photosensitive layer disposed on the substrate. The photosensitive layer has usually a high resistance (for example, the resistance of an ordinary resin), but has a property in that upon irradiation with a laser beam 3Y, the specific resistance of the portion irradiated with the laser beam changes. Then, the laser beam 3Y is output through the exposure device 3 onto the charged surface of the photoreceptor 1Y according to image data for yellow color sent from a control section not shown. The photosensitive layer on the surface of the photoreceptor 1Y is irradiated with the laser beam 3Y. Thus, an electrostatic charge image of a yellow image pattern is formed on the surface of the photoreceptor 1Y.

The electrostatic charge image is an image formed on the surface of the photoreceptor 1Y by charging and is a so-called negative latent image that is formed when the specific resistance of a portion of the photosensitive layer irradiated with the laser beam 3Y decreases, whereby the charges has been present on the surface of the photoreceptor 1Y flow, while the charge that is present in a portion that is not irradiated with the laser beam 3Y remains.

The electrostatic charge image thus formed on the photoreceptor 1Y is rotated to a given development position according to the rotation of the photoreceptor 1Y. Then, at the development position, the electrostatic charge image on the photoreceptor 1Y is formed into a visible image (developed image) as a toner image by the developing device 4Y.

The developing device 4Y contains an electrostatic charge image developer including at least a yellow toner and a carrier, for example. The yellow toner is charged by friction caused by stirring in the developing device 4Y, so as to have a charge having the same polarity (negative polarity) as that of the charge present on the photoreceptor 1Y, and is held on a developer roller (one example of a developer holding member). Then, when the surface of the photoreceptor 1Y passes through the developing device 4Y, the yellow toner elastostatically adheres to a latent image portion, in which charges are erased, on the surface of the photoreceptor 1Y, whereby the latent image is developed by the yellow toner. The photoreceptor 1Y on which the yellow toner image has been formed is successively made to run at a given speed, and then the toner image developed on the photoreceptor 1Y is conveyed to a given primary transfer position.

When the yellow toner image on the photoreceptor 1Y is conveyed to the primary transfer position, a given primary transfer bias is applied to the primary transfer roller 5Y, and electrostatic force towards the primary transfer roller 5Y from the photoreceptor 1Y acts on the toner image, and as a result, the toner image on the photoreceptor 1Y is transferred onto the intermediate transfer belt 20. The transfer bias applied at this time has a (+) polarity which is opposite to the polarity (−) of the toner, and for example, in the first unit 10Y, the transfer bias is controlled to be +26 μA by a control section (not shown).

In the photoreceptor 1Y, after the toner image is transferred onto the intermediate transfer belt 20, currents for erasing charges (hereinafter referred to as a "charge erasing bias" in some cases) are applied by a primary transfer roller 5Y. Further, the charge erasing bias applied to the respective photoreceptors 1Y, 1M, 1C, and 1K may be applied after the toner image is transferred to the intermediate transfer belt 20 and before it is charged by the respective charging devices (charging rollers 2Y, 2M, 2C, and 2K), or may be applied after the toner image primarily transferred onto the intermediate transfer belt 20 is secondarily transferred to a recording paper sheet P.

The charge erasing bias applied to the photoreceptor 1Y has a (+) polarity that is a polarity opposite to that of the residual charges, and is preferably from 5 μA to 50 μA. If the charge erasing bias is equal to or more than 10 μA, the voltage remaining in the photoreceptor 1Y is reliably erased, whereas if the charge erasing bias is equal to or less than 50 μA, unevenness of an image density by re-transfer of the toner charged with opposite polarity from the intermediate transfer belt 20 to the photoreceptor 1Y due to excess voltage may be prevented. From this viewpoint, the charge erasing bias is preferably from 10 μA to 40 μA, and still more preferably from 15 μA to 30 μA.

On the other hand, the toner remaining on the photoreceptor 1Y is erased by a photoreceptor cleaning device 6Y, and recovered.

Furthermore, the primary transfer bias and the charge erasing bias applied to the primary transfer rollers 5M, 5C, and 5K after the second unit 10M are controlled in a similar manner to that in the first unit.

Thus, the intermediate transfer belt 20 onto which the yellow toner image has been transferred by the first unit 10Y is sequentially conveyed through the second to fourth units 10M, 10C, and 10K, and toner images of the respective colors are superimposed thereon and multi-transferred.

The intermediate transfer belt 20 to which the toner image of four colors have been multi-transferred through the first to fourth units conveys the toner image to a secondary transfer position configured with the intermediate transfer belt 20, the back-up roller 24 which contacts with the inner surface of the intermediate transfer belt, and a secondary transfer roller (one example of a secondary transfer unit) 26 located at the image holding side of the intermediate transfer belt 20. Meanwhile, a recording paper sheet (one example of a recording medium) P is fed to a space between the secondary transfer roller 26 and the intermediate transfer belt 20, which are pressed against each other, by a paper feed mechanism at a given timing, and a given secondary transfer bias is applied to the back-up roller 24. The transfer bias applied at this time has a (−) polarity which is the same as the polarity (−) of a toner. Thus, electrostatic force towards the recording paper sheet P from the intermediate transfer belt 20 acts on the toner image, whereby the toner image on the intermediate transfer belt 20 is transferred onto the recording paper sheet P. The secondary transfer bias in this case is determined according to an electrical resistance detected by a resistance detecting unit (not shown) that detects the electrical resistance of the secondary transfer device, and is controlled by changing voltage.

Thereafter, the recording paper sheet P is transported to nip sections of a pair of fixation rollers in a fixing device (one example of a fixing unit) 28, and the toner image is fixed on the recording paper sheet P, thereby forming a fixed image.

Examples of the recording paper sheet P that transfers a toner image include plain paper sheets used for an electrophotographic copier, a printer, or the like. Examples of the recording medium include an OHP sheet, in addition to a recording paper sheet P.

In order to further improve the smoothness of the image surface after fixation, a smooth surface of the recording paper sheet P is preferable, and for example, a coat paper having a resin or the like coated on the surface of a plain paper sheet, an art paper sheet for printing, or the like is suitably used.

The recording paper sheet P on which fixation of a color image has been completed is discharged to a discharging section, and thus, a series of color image formation operations are finished.

Hereinafter, the configuration of the image forming apparatus according to the exemplary embodiment will be specifically described.

Electrophotographic Photoreceptor

The electrophotographic photoreceptor (hereinafter also referred to as a "photoreceptor") has an electroconductive substrate and a photosensitive layer that is provided on the electroconductive substrate and includes at least one selected from the group consisting of a hindered phenol antioxidant and a benzophenone ultraviolet absorber.

Figure 2:
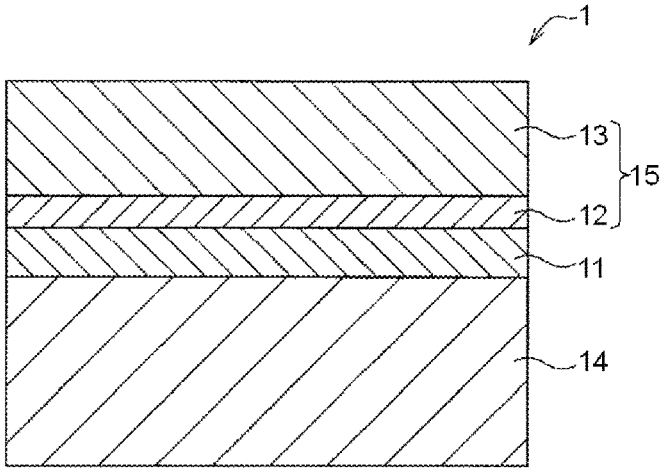
FIG. 2 is a schematic partial cross-sectional diagram showing one example of the layer configuration of the electrophotographic photoreceptor in the exemplary embodiment.

FIG. 2 is a schematic partial cross-sectional diagram showing one example of the layer configuration of the electrophotographic photoreceptor 1 in the exemplary embodiment. The electrophotographic photoreceptor 1 shown in FIG. 2 has a structure in which an undercoat layer 11, a charge generation layer 12, and a charge transport layer 13 are laminated in order on an electroconductive substrate 14. The charge generation layer 12 and the charge transport layer 13 constitute a photosensitive layer 15.

The electrophotographic photoreceptor 1 may have a layer configuration in which the undercoat layer 11 is not provided. Further, the electrophotographic photoreceptor 1 may have a layer configuration in which a protective layer is further provided on the charge transport layer 13. In addition, in each of the electrophotographic photoreceptors 1 may be a single-layer photosensitive layer having an integration of the functions of the charge generation layer 12 and the charge transport layer 13.

Hereinafter, the respective elements of the electrophotographic photoreceptor will be described. Further, the symbols of the respective elements will be omitted in the description.

Electroconductive Substrate

Examples of the electroconductive substrate include metal plates, metal drums, and metal belts containing metals (aluminum, copper, zinc, chromium, nickel, molybdenum, vanadium, indium, gold, platinum, and the like) or alloys (stainless steel and the like). Other examples of the electroconductive substrate include paper, resin films, and belts, each formed by applying, depositing, or laminating conductive compounds (for example, a conductive polymer and indium oxide), metals (for example, aluminum, palladium, and gold), or alloys. The term "being conductive" herein refers to having a volume resistivity of less than $10^{13}$ Ωcm.

In the case where the electrophotographic photoreceptor is used in a laser printer, the surface of the electroconductive substrate is preferably roughened at a center-line average roughness, Ra, which is from 0.04 μm to 0.5 μm in order to prevent an interference fringe generated upon radiation with laser light. In the case where an incoherent light source is used, there is no particular need for the surface of the electroconductive substrate to be roughened so as to prevent an interference fringe, and such an incoherent light source may prevent occurrence of defects due to uneven surface of the electroconductive substrate, and is therefore more suitable for prolonging the lifetime.

Examples of a surface roughening method include wet honing in which an abrasive suspended in water is sprayed to a support, centerless grinding in which continuous grinding is carried out by pressing the electroconductive substrate against a rotating grindstone, and an anodization treatment.

Other examples of the surface roughening method include a method in which while not roughening the surface of the electroconductive substrate, conductive or semiconductive powder is dispersed in a resin, the resin is applied onto the surface of the electroconductive substrate to form a layer, and roughening is carried out by the particles dispersed in the layer.

In the surface roughening treatment by anodization, an electroconductive substrate formed of a metal (for example, aluminum) serves as the anode in an electrolyte solution and is anodized to form an oxide film on the surface of the electroconductive substrate. Examples of the electrolyte solution include a sulfuric acid solution and an oxalic acid solution. A porous anodized film formed by anodizing is, however, chemically active in its natural state, and thus, such an anodized film is easily contaminated, and its resistance greatly varies depending on environment. Accordingly, a treatment for closing the pores of the porous anodized film is preferably carried out; in such a process, the pores of the oxidized film are closed by volume expansion due to a hydration reaction in steam under pressure or in boiled water (a metal salt such as nickel may be added), and the porous anodized film is converted into more stable hydrous oxide.

The film thickness of the anodized film is preferably, for example, from 0.3 μm to 15 μm. If the film thickness is within this range, a barrier property for implantation tends to be exerted and an increase in residual potential due to repeated uses tends to be prevented.

The electroconductive substrate may be subjected to a treatment with an acidic treatment solution or a boehmite treatment.

The treatment with an acidic treatment solution is carried out, for example, as follows. An acidic treatment solution containing phosphoric acid, chromic acid, and hydrofluoric acid is prepared. For the blend ratio of the phosphoric acid, the chromic acid, and the hydrofluoric acid in the acidic treatment solution, for instance, the amount of the phosphoric acid is in the range from 10% by weight to 11% by weight, the amount of the chromic acid is in the range from 3% by weight to 5% by weight, and the amount of the hydrofluoric acid is in the range from 0.5% by weight to 2% by weight, and the total concentration of these acids is preferably in the range from 13.5% by weight to 18% by weight. The temperature for the treatment is preferably, for example, from 42° C. to 48° C. The film thickness of the coating film is preferably from 0.3 μm to 15 μm.

In the boehmite treatment, for example, the electroconductive substrate is immersed into pure water at a temperature from 90° C. to 100° C. from 5 minutes to 60 minutes or brought into contact with heated water vapor at a temperature from 90° C. to 120° C. from 5 minutes to 60 minutes. The film thickness of the coating film is preferably from 0.1 μm to 5 μm. The obtained product may be subjected to an anodization treatment with an electrolyte solution which less dissolves the coating film, such as adipic acid, boric acid, borate, phosphate, phthalate, maleate, benzoate, tartrate, and citrate.

Undercoat Layer

The undercoat layer is a layer including, for example, inorganic particles and a binder resin.

Examples of the inorganic particles include inorganic particles having a powder resistivity (volume resistivity) that is from $10^2$ Ωcm to $10^{11}$ Ωcm.

Among these, as the inorganic particles having such a resistance value, metal oxide particles such as tin oxide particles, titanium oxide particles, zinc oxide particles, and zirconium oxide particles are preferable, and zinc oxide particles are particularly preferable.

The specific surface area of the inorganic particles in accordance with a BET method is preferably, for example, equal to or more than 10 $m^2/g$.

The volume average particle diameter of the inorganic particles is preferably, for example, from 50 nm to 2,000 nm (particularly from 60 nm to 1,000 nm).

The content of the inorganic particles is preferably, for example, from 10% by weight to 80% by weight, and more preferably from 40% by weight to 80% by weight, with respect to the binder resin.

The inorganic particles may have been subjected to a surface treatment. Two or more kinds of inorganic particles which have been subjected to different surface treatments or which have different particle diameters may be used as a mixture.

Examples of the surface treating agent include a silane coupling agent, a titanate coupling agent, an aluminum coupling agent, and a surfactant. In particular, a silane coupling agent is preferable, and a silane coupling agent having an amino group is more preferable.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more kinds of silane coupling agents may be used as a mixture. For example, the silane coupling agent having an amino group may be used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using a surface treating agent may be carried out by any known technique, and either a dry process or a wet process may be employed.

The amount of the surface treating agent used for the treatment is preferably, for example, from 0.5% by weight to 10% by weight with respect to the inorganic particles.

Here, it is preferable that the undercoat layer contains an electron accepting compound (acceptor compound) in addition to the inorganic particles from the viewpoints of the long-term stability of electrical properties and an increase in carrier blocking properties.

Examples of the electron accepting compound include electron transporting materials, including, for example, quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, compounds having an anthraquinone structure are preferable as the electron accepting compound. As the compounds having an anthraquinone structure, a hydroxyanthraquinone compound, an aminoanthraquinone compound, and an aminohydroxyanthraquinone compound are preferable, and specifically, for example, anthraquinone, alizarin, quinizarin, anthrarufin, and purpurin are preferable.

The electron accepting compound may be included in the undercoat layer after having been dispersed together with the inorganic particles therein, or may be included after having adhered to the surfaces of the inorganic particles.

Examples for allowing the electron accepting compound to adhere to the surfaces of the inorganic particles include a dry process and a wet process.

The dry process is, for example, a method in which an electron accepting compound is allowed to adhere to the surfaces of the inorganic particles as follows: inorganic particles are stirred in a mixer with a high shear force, and in this state, the electron accepting compound as it is or as a solution in which the electron accepting compound has been dissolved in an organic solvent is dropped or sprayed along with dried air or a nitrogen gas. The electron accepting compound may be dropped or sprayed at a temperature that is equal to or lower than the boiling point of the solvent. After dropping or spraying the electron accepting compound, baking may be carried out at equal to or higher than 100° C. Baking may be carried out at any temperature for any length of time provided that electrophotographic properties are obtained.

The wet process is, for example, a method in which the electron accepting compound is allowed to adhere to the surfaces of the inorganic particles as follows: the inorganic particles are dispersed in a solvent by a technique involving stirring, ultrasonic wave, a sand mill, an attritor, or a ball mill, in this state, the electron accepting compound is added thereto and then stirred or dispersed, and the solvent is subsequently removed. The solvent is removed through, for example, being filtered or distilled off by distillation. After the removal of the solvent, baking may be carried out at equal to or higher than 100° C. Baking may be carried out at any temperature for any length of time provided that electrophotographic properties are obtained. In the wet process, the moisture content in the inorganic particles may be removed in advance of the addition of the electron accepting compound, and examples of the wet process include a method in which a moisture content is removed by stirring in a solvent under heating or a method in which a moisture content is removed by azeotropy with a solvent.

Moreover, the electron accepting compound may be allowed to adhere before or after the surface treatment of the inorganic particles with a surface treating agent, and the adhesion of the electron accepting compound and the surface treatment with the surface treating agent may be simultaneously carried out.

The content of the electron accepting compound is, for example, preferably from 0.01% by weight to 20% by weight, and more preferably from 0.01% by weight to 10% by weight, with respect to the inorganic particles.

Examples of the binder resin for use in the undercoat layer include known high molecular compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin for use in the undercoat layer include electron transporting resins having electron transporting groups and conductive resins (for example, polyaniline).

Among these, a resin that is insoluble in a solvent used in a coating liquid for forming the upper layer is suitable as the binder resin for use in the undercoat layer. In particular, resins obtained by a reaction of a curing agent with at least one resin selected from the group consisting of thermosetting resins such as urea resins, phenolic resins, phenol-formaldehyde resins, melamine resins, urethane resins, unsaturated polyester resins, alkyd resins, and epoxy resins; polyamide resins; polyester resins; polyether resins; methacrylic resins; acrylic resins; polyvinyl alcohol resins; and polyvinyl acetal resins are suitable.

In the case where two or more kinds of these binder resins are used in combination, the mixing ratio thereof is determined, as desired.

The undercoat layer may include a variety of additives in order to improve electrical properties, environmental stability, and image quality.

Examples of the additives include electron transporting pigments such as condensed polycyclic pigments and azo pigments, and known materials such as zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above and may be further added as an additive to the undercoat layer.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconiumlaurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimers, tetra(2-ethylhexyl)titanate, titanium acetylacetonate, polytitanium acetylacetonate, titanium octyleneglycolate, titanium lactate ammonium salts, titanium lactate, titanium lactate ethyl esters, titanium triethanolaminate, and polyhydroxytitanium stearate.

Examples of the aluminum chelate compounds include aluminum isopropylate, monobutoxyaluminum diisopropylate, aluminum butylate, diethyl acetoacetate aluminum diisopropylate, and aluminum tris(ethyl acetoacetate).

These additives may be used alone or as a mixture or a polycondensate of plural kinds thereof.

The undercoat layer is preferably one having a Vickers hardness of equal to or more than 35.

In order to prevent a moire fringe, the surface roughness (ten-point average roughness) of the undercoat layer is preferably adjusted to a range from 1/(4 n) (n is the refractive index of the upper layer) to ½ of the laser wavelength λ for exposure to be used.

In order to adjust the surface roughness, resin particles or the like may be added to the undercoat layer. Examples of the resin particles include silicone resin particles and crosslinked polymethyl methacrylate resin particles. In addition, the surface of the undercoat layer may be polished to adjust the surface roughness. Examples of a polishing method include buffing polishing, sand blasting treatment, wet honing, and grinding treatment.

A technique for forming the undercoat layer is not particularly limited, and any known technique is used. For example, formation of the undercoat layer is carried out by forming a coating film of a coating liquid for forming an undercoat layer that has been prepared by adding the components to a solvent, and then drying the coating film, followed by heating, as desired.

Examples of the solvent for use in the preparation of the coating liquid for forming an undercoat layer include known organic solvents such as an alcohol solvent, an aromatic hydrocarbon solvent, a halogenated hydrocarbon solvent, a ketone solvent, a ketone alcohol solvent, an ether solvent, and an ester solvent.

Specific examples of these solvents include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing the inorganic particles in the preparation of the coating liquid for forming an undercoat layer include known methods using a roller mill, a ball mill, a vibratory ball mill, an attritor, a sand mill, a colloid mill, a paint shaker, or the like.

Examples of a method for applying the coating liquid for forming an undercoat layer onto the electroconductive substrate include common methods such as a blade coating method, a wire-bar coating method, a spray coating method, a dipping coating method, a bead coating method, an air knife coating method, and a curtain coating method.

The film thickness of the undercoat layer is set to be, for example, preferably in the range of equal to or more than 15 μm, and more preferably in the range from 20 μm to 50 μm.

Intermediate Layer

Although not shown in the drawings, an interlayer may further be provided between the undercoat layer and the photosensitive layer.

The intermediate layer is, for example, a layer including a resin. Examples of the resin for use in the intermediate layer include polymeric compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound for use in the intermediate layer include those that contain metal atoms such as zirconium, titanium, aluminum, manganese, and silicon.

These compounds for use in the intermediate layer may be used alone or as a mixture or a polycondensate of plural kinds of the compounds.

Among these, the intermediate layer is preferably a layer that includes an organic metal compound containing a zirconium atom or a silicon atom.

A technique for forming the intermediate layer is not particularly limited, and known methods are used. For example, formation of a coating film is carried out by forming a coating film of a coating liquid for forming an intermediate layer, which has been prepared by adding the components to a solvent, drying the coating film, followed by heating, as desired.

As a coating method used for forming the intermediate layer, common methods such as a dipping coating method, an extrusion coating method, a wire bar coating method, a spray coating method, a blade coating method, a knife coating method, and a curtain coating method are used.

The film thickness of the intermediate layer is preferably set to be, for example, in the range from 0.1 μm to 3 μm. In addition, the intermediate layer may be used as an undercoat layer.

Charge Generation Layer

The charge generation layer is a layer including, for example, a charge generating material and a binder resin. Further, the charge generation layer may be a vapor-deposited layer of a charge generating material. The vapor-deposited layer of a charge generating material is suitable in the case where an incoherent light source such as a Light Emitting Diode (LED) or an Organic Electro-Luminescence (EL) image array is used.

Examples of the charge generating material include azo pigments such as bisazo and trisazo pigments; fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment is preferably used as a charge generating material in order to be compatible with laser exposure in a near-infrared region. Specifically, for example, hydroxygallium phthalocyanine, chlorogallium phthalocyanine, dichlorotin phthalocyanine, and titanyl phthalocyanine are more preferable.

On the other hand, in order to be compatible with laser exposure in a near-ultraviolet region, fused aromatic pigments such as dibromoanthanthrone; thioindigo pigments; porphyrazine compounds; zinc oxide; trigonal selenium, bisazo pigments are preferable as a charge generating material.

The charge generating materials may be used even in the case where an incoherent light source such as an organic EL image array or an LED having a center wavelength for light emission within the range from 450 nm to 780 nm is used. However, when the photosensitive layer is designed as a thin film having a thickness of equal to or less than 20 μm from the viewpoint of resolution, the electric field strength in the photosensitive layer increases and electrification obtained from charge injection from the electroconductive substrate decreases, thereby readily generating image defects referred to a so-called black spot. This phenomenon becomes notable when a charge generating material, such as trigonal selenium or a phthalocyanine pigment, that readily generates dark current in a p-type semiconductor is used.

In contrast, when a n-type semiconductor such as a fused aromatic pigment, a perylene pigment, and an azo pigment is used as the charge generating material, dark current rarely occurs and image defects referred to black spot are prevented even in the case where the photoconductive layer is in the form of a thin film. Examples of the n-type charge generating material include, but are not limited to, the compounds (CG-1) to (CG-27) described in paragraphs [0288] to [0291] of JP-A-2012-155282.

Furthermore, whether the material is of a n-type is determined by the polarity of the photocurrent that flows in a commonly used time-of-flight method and the material in which electrons rather than holes easily flow as a carrier is identified as the n-type.

The binder resin for use in the charge generation layer may be selected from a wide variety of insulating resins. Further, the binder resin may be selected from organic photoconductive polymers such as poly-N-vinylcarbazole, polyvinylanthracene, polyvinylpyrene, and polysilane.

Examples of the binder resin in the charge generation layer include polyvinyl butyral resins, polyarylate resins (a polycondensate of a bisphenol and a divalent aromatic dicarboxylic acid, and the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "being insulating" herein refers to having a volume resistivity of equal to or more than $10^{13}$ Ωcm.

The binder resin may be used alone or as a mixture of two or more kinds thereof.

Moreover, the blend ratio of the charge generating material to the binder resin is preferably in the range from 10:1 to 1:10 in terms of weight ratio.

The charge generation layer may include other known additives.

A technique for forming the charge generation layer is not particularly limited, and known forming methods are used. For example, formation of the charge generation layer is carried out by forming a coating film of a coating liquid for forming a charge generation layer in which the components are added to a solvent, and drying the coating film, followed by heating, as desired. Further, formation of the charge generation layer may be carried out by vapor deposition of the charge generating materials. Formation of the charge generation layer by vapor deposition is particularly suitable in the case where a fused aromatic pigment or a perylene pigment is used as the charge generating material.

Examples of the solvent for preparing the coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more kinds thereof.

For a method for dispersing particles (for example, charge generating materials) in the coating liquid for forming a charge generation layer, media dispersers such as a ball mill, a vibratory ball mill, an attritor, a sand mill, and a horizontal sand mill or a medialess disperser such as a stirrer, an ultrasonic disperser, a roller mill, and a high-pressure homogenizer are used. Examples of the high-pressure homogenizer include a collision-type homogenizer in which dispersing is performed by subjecting the dispersion to liquid-liquid collision or liquid-wall collision in a high-pressure state and a penetration-type homogenizer in which dispersing is performed by causing the dispersion to penetrate fine channels in a high pressure state.

Incidentally, during the dispersion, it is effective to adjust the average particle diameter of the charge generating material in the coating liquid for forming a charge generation layer to equal to or less than 0.5 μm, preferably equal to or less than 0.3 μm, and more preferably equal to or less than 0.15 μm.

Examples of the method for applying the undercoat layer (or the intermediate layer) with the coating liquid for forming a charge generation layer include common methods such as a blade coating method, a wire bar coating method, a spray coating method, a dipping coating method, a bead coating method, an air knife coating method, and a curtain coating method.

The film thickness of the charge generation layer is set to be, for example, preferably in the range from 0.1 μm to 5.0 μm, and more preferably in the range from 0.2 μm to 2.0 μm.

Charge Transport Layer

The charge transport layer includes, for example, a charge transport material and a binder resin, and includes at least one selected from the group consisting of a hindered phenol antioxidant and a benzophenone ultraviolet absorber.

Charge Transport Material

As a charge transport material, a charge transport material represented by the following formula (CT1) (hereinafter referred to as a "butadiene charge transport material (CT1)" in some cases) is preferable. The butadiene charge transport material CT1 has a high charge transport speed and excellent charge transport properties to the surface of the charge transport layer, and therefore, the residual charges are easily released and the butadiene charge transport material CT1 is advantageous for the transfer at a high speed.

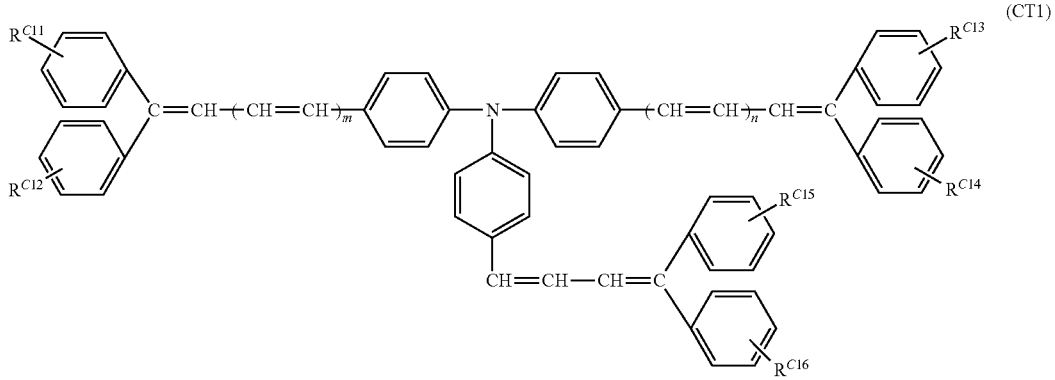

(CT1)

In formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having 1 to 20 carbon atoms, an alkoxy group having 1 to 20 carbon atoms, or an aryl group having 6 to 30 carbon atoms, and two adjacent substituents may be bonded to each other to form a hydrocarbon ring structure.

n and m each independently represent 0, 1, or 2.

In formula (CT1), examples of the halogen atoms represented by $R^{C11}$, $R^{C12}$, $R^{C13}$, $R^{C14}$, $R^{C15}$, and $R^{C16}$ include a fluorine atom, a chlorine atom, a bromine atom, and an iodine atom. Among these, as the halogen atom, a fluorine atom and a chlorine atom are preferable, and a chlorine atom is more preferable.

In formula (CT1), examples of the alkyl groups represented by $R^{C11}$, $R^{C12}$, $R^{C13}$, $R^{C14}$, $R^{C15}$, and $R^{C16}$ include a linear or branched alkyl group having 1 to 20 carbon atoms (preferably having 1 to 6 carbon atoms, and more preferably having 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, a n-decyl group, a n-undecyl group, a n-dodecyl group, a n-tridecyl group, a n-tetradecyl group, a n-pentadecyl group, a n-hexadecyl group, a n-heptadecyl group, a n-octadecyl group, a n-nonadecyl group, and a n-eicosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoeicosyl group, a sec-eicosyl group, a tert-eicosyl group, and a neoeicosyl group.

Among these, lower alkyl groups such as a methyl group, an ethyl group, and an isopropyl group are preferable as the alkyl group.

In formula (CT1), examples of the alkoxy groups represented by $R^{C11}$, $R^{C12}$, $R^{C13}$, $R^{C14}$, $R^{C15}$, and $R^{C16}$ include a linear or branched alkoxy group having 1 to 20 carbon atoms (preferably having 1 to 6 carbon atoms, and more preferably having 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, a n-decyloxy group, a n-undecyloxy group, a n-dodecyloxy group, a n-tridecyloxy group, a n-tetradecyloxy group, a n-pentadecyloxy group, a n-hexadecyloxy group, a n-heptadecyloxy group, a n-octadecyloxy group, a n-nonadecyloxy group, and a n-eicosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl- 4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoeicosyloxy group, a sec-eicosyloxy group, a tert-eicosyloxy group, and a neoeicosyloxy group.

Among these, a methoxy group is preferable as the alkoxy group.

In formula (CT1), examples of the aryl groups represented by $R^{C11}$, $R^{C12}$, $R^{C13}$, $R^{C14}$, $R^{C15}$, and $R^{C16}$ include an aryl group having 6 to 30 carbon atoms (preferably having 6 to 20 carbon atoms, and more preferably having 6 to 16 carbon atoms).

Specific examples of the aryl group include a phenyl group, a naphthyl group, a phenanthryl group, and a biphenylyl group.

Among these, a phenyl group and a naphthyl group are preferable as the aryl group.

Furthermore, in formula (CT1), the respective substituents represented by $R^{C11}$, $R^{C12}$, $R^{C13}$, $R^{C14}$, $R^{C15}$, and $R^{C16}$ also include groups further having substituents. Examples of the substituents include atoms and groups exemplified above (for example, a halogen atom, an alkyl group, an alkoxy group, and an aryl group).

In formula (CT1), examples of the groups linking the substituents in the hydrocarbon ring structures in which two adjacent substituents (for example, $R^{C11}$ and $R^{C12}$, $R^{C13}$ and $R^{C14}$, and $R^{C15}$ and $R^{C16}$) of $R^{C11}$, $R^{C12}$, $R^{C13}$, $R^{C14}$, $R^{C15}$, and $R^{C16}$ are linked to each other include a single bond, a 2,2'-methylene group, a 2,2'-ethylene group, and a 2,2'-vinylene group, and among these, a single bond and a 2,2'-methylene group are preferable.

Here, specific examples of the hydrocarbon ring structure include a cycloalkane structure, a cycloalkene structure, and a cycloalkanepolyene structure.

In formula (CT1), n and m are preferably 1.

In formula (CT1), from the viewpoint of obtaining a photosensitive layer (charge transport layer) having high charge transportability, it is preferable that $R^{C11}$, $R^{C12}$, $R^{C13}$, $R^{C14}$, $R^{C15}$, and $R^{C16}$ represent a hydrogen atom, an alkyl group having 1 to 20 carbon atoms, or an alkoxy group having 1 to 20 carbon atoms, and m and n represent 1 or 2, and it is more preferable that $R^{C11}$, $R^{C12}$, $R^{C13}$, $R^{C14}$, $R^{C15}$, and $R^{C16}$ represent a hydrogen atom, and m and n represent 1.

That is, it is more preferable that the butadiene charge transport material (CT1) is a charge transport material (exemplary compound (CT1-3)) represented by the following Structural formula (CT1A).

(CT1A)

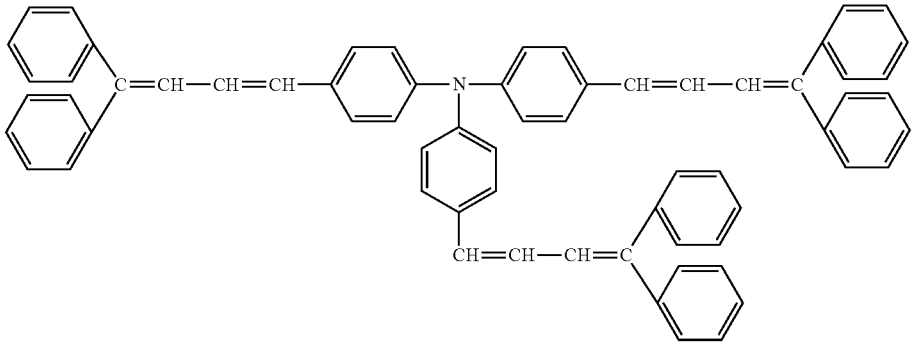

Specific examples of the butadiene charge transport material (CT1) are shown below, and are not limited thereto.

| Exemplary compound No. | m | n | $R^{C11}$ | $R^{C12}$ | $R^{C13}$ | $R^{C14}$ | $R^{C15}$ | $R^{C16}$ |
|---|---|---|---|---|---|---|---|---|
| CT1- 1 | 1 | 1 | 4-$CH_3$ | 4-$CH_3$ | 4-$CH_3$ | 4-$CH_3$ | H | H |
| CT1- 2 | 2 | 2 | H | H | H | H | 4-$CH_3$ | 4-$CH_3$ |
| CT1- 3 | 1 | 1 | H | H | H | H | H | H |
| CT1- 4 | 2 | 2 | H | H | H | H | H | H |
| CT1- 5 | 1 | 1 | 4-$CH_3$ | 4-$CH_3$ | 4-$CH_3$ | H | H | H |
| CT1- 6 | 0 | 1 | H | H | H | H | H | H |
| CT1- 7 | 0 | 1 | 4-$CH_3$ | 4-$CH_3$ | 4-$CH_3$ | 4-$CH_3$ | 4-$CH_3$ | 4-$CH_3$ |
| CT1- 8 | 0 | 1 | 4-$CH_3$ | 4-$CH_3$ | H | H | 4-$CH_3$ | 4-$CH_3$ |
| CT1- 9 | 0 | 1 | H | H | 4-$CH_3$ | 4-$CH_3$ | H | H |
| CT1-10 | 0 | 1 | H | H | 4-$CH_3$ | 4-$CH_3$ | H | H |
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |

-continued

| Exemplary compound No. | m | n | $R^{C11}$ | $R^{C12}$ | $R^{C13}$ | $R^{C14}$ | $R^{C15}$ | $R^{C16}$ |
|---|---|---|---|---|---|---|---|---|
| CT1-16 | 1 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

Furthermore, the abbreviated symbols in the exemplary compounds represent the following meanings. Further, the numbers attached before the substituents represent the substitution positions with respect to the benzene ring.

—$CH_3$: Methyl group

—$OCH_3$: Methoxy group

The butadiene charge transport material (CT1) may be used alone or in combination of two or more kinds thereof.

The charge transport layer may include, as a charge transport material, a charge transport material represented by the following formula (CT2) (hereinafter referred to as a "benzidine charge transport material (CT2)" in some cases).

(CT2)

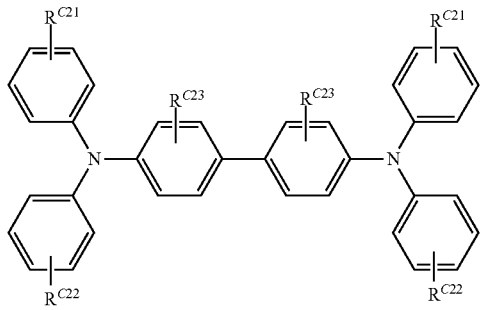

In formula (CT2), $R^{C21}$, $R^{C22}$, and $R^{C23}$ each independently represent a hydrogen atom, a halogen atom, an alkyl group having 1 to 10 carbon atoms, an alkoxy group having 1 to 10 carbon atoms, or an aryl group having 6 to 10 carbon atoms.

In formula (CT2), examples of the halogen atoms represented by $R^{C21}$, $R^{C22}$, and $R^{C23}$ include a fluorine atom, a chlorine atom, a bromine atom, and an iodine atom. Among these, as the halogen atom, a fluorine atom and a chlorine atom are preferable, and a chlorine atom is more preferable.

In formula (CT2), examples of the alkyl groups represented by $R^{C21}$, $R^{C22}$, and $R^{C23}$ include a linear or branched alkyl group having 1 to 10 carbon atoms (preferably having 1 to 6 carbon atoms, and more preferably having 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, and a n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group, an ethyl group, and an isopropyl group are preferable as the alkyl group.

In formula (CT2), examples of the alkoxy groups represented by $R^{C21}$, $R^{C22}$, and $R^{C23}$ include a linear or branched alkoxy group having 1 to 10 carbon atoms (preferably having 1 to 6 carbon atoms, and more preferably having 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is preferable as the alkoxy group.

In formula (CT2), examples of the aryl groups represented by $R^{C21}$, $R^{C22}$, and $R^{C23}$ include an aryl group having 6 to 10 carbon atoms (preferably having 6 to 9 carbon atoms, and more preferably having 6 to 8 carbon atoms).

Specific examples of the aryl group include a phenyl group and a naphthyl group.

Among these, a phenyl group is preferable as the aryl group.

Moreover, in formula (CT2), the respective substituents represented by $R^{C21}$, $R^{C22}$, and $R^{C23}$ also include groups further having substituents. Examples of the substituents include atoms and groups exemplified above (for example, a halogen atom, an alkyl group, an alkoxy group, and an aryl group).

In formula (CT2), particularly from the viewpoint of obtaining a photosensitive layer (charge transport layer) having high charge transportability, it is preferable that $R^{C21}$, $R^{C22}$, and $R^{C23}$ each independently represent a hydrogen atom or an alkyl group having 1 to 10 carbon atoms, and it is more preferable that $R^{C21}$ and $R^{C23}$ represent a hydrogen atom, and $R^{C22}$ represents an alkyl group having 1 to 10 carbon atoms (particularly a methyl group).

Specifically, it is particularly preferable that the benzidine charge transport material (CT2) is a charge transport material (exemplary compound (CT2-2)) represented by the following Structural formula (CT2A).

(CT2A)

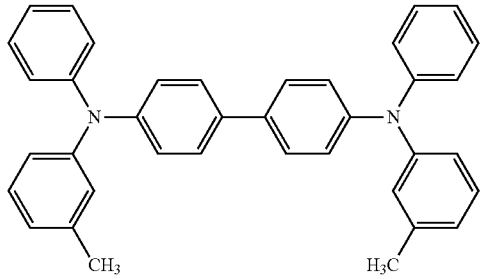

Specific examples of the benzidine charge transport material (CT2) are shown below, and are not limited thereto.

| Exemplary compound No. | $R^{C21}$ | $R^{C22}$ | $R^{C23}$ |
|---|---|---|---|
| CT2-1 | H | H | H |
| CT2-2 | H | 3-$CH_3$ | H |
| CT2-3 | H | 4-$CH_3$ | H |
| CT2-4 | H | 3-$C_2H_5$ | H |
| CT2-5 | H | 4-$C_2H_5$ | H |
| CT2-6 | H | 3-$OCH_3$ | H |
| CT2-7 | H | 4-$OCH_3$ | H |
| CT2-8 | H | 3-$OC_2H_5$ | H |
| CT2-9 | H | 4-$OC_2H_5$ | H |
| CT2-10 | 3-$CH_3$ | 3-$CH_3$ | H |
| CT2-11 | 4-$CH_3$ | 4-$CH_3$ | H |
| CT2-12 | 3-$C_2H_5$ | 3-$C_2H_5$ | H |
| CT2-13 | 4-$C_2H_5$ | 4-$C_2H_5$ | H |
| CT2-14 | H | H | 2-$CH_3$ |
| CT2-15 | H | H | 3-$CH_3$ |
| CT2-16 | H | 3-$CH_3$ | 2-$CH_3$ |
| CT2-17 | H | 3-$CH_3$ | 3-$CH_3$ |
| CT2-18 | H | 4-$CH_3$ | 2-$CH_3$ |
| CT2-19 | H | 4-$CH_3$ | 3-$CH_3$ |
| CT2-20 | 3-$CH_3$ | 3-$CH_3$ | 2-$CH_3$ |
| CT2-21 | 3-$CH_3$ | 3-$CH_3$ | 3-$CH_3$ |
| CT2-22 | 4-$CH_3$ | 4-$CH_3$ | 2-$CH_3$ |
| CT2-23 | 4-$CH_3$ | 4-$CH_3$ | 3-$CH_3$ |

Moreover, the abbreviated symbols in the exemplary compounds represent the following meanings. Further, the numbers attached before the substituents represent the substitution positions with respect to the benzene ring.

—$CH_3$: Methyl group

—$C_2H_5$: Ethyl group

—$OCH_3$: Methoxy group

—$OC_2H_5$: Ethoxy group

The benzidine charge transport material (CT2) may be used alone or in combination of two or more kinds thereof.

Hindered Phenol-Based Antioxidant

The hindered phenol antioxidant will be described.

The hindered phenol antioxidant is a compound having a hindered phenol ring, which preferably has a molecular weight of equal to or more than 300. If the molecular weight of the hindered phenol antioxidant is equal to or more than 300, volatilization of the hindered phenol antioxidant during the drying while forming the photosensitive layer is prevented and thus easily remains in the photosensitive layer, and therefore, it is easy to obtain an operational effect due to the hindered phenol antioxidant.

In the hindered phenol antioxidant, the hindered phenol ring is, for example, a phenol ring having at least one of alkyl groups having 4 to 8 carbon atoms) (for example, branched alkyl groups having 4 to 8 carbon atoms) substituted therein. More specifically, the hindered phenol ring is, for example, a phenol ring in which an ortho position with respect to the phenolic hydroxyl group is substituted with a tertiary alkyl group (for example, a tert-butyl group).

Examples of the hindered phenol antioxidant include:

1) an antioxidant having one hindered phenol ring, 2) an antioxidant having 2 to 4 hindered phenol rings, in which a linking group formed of linear or branched bi- to tetravalent aliphatic hydrocarbon groups, or a linking group having at least one of an ester bond (—C(=O)O—) and an ether bond (—O—) interposed between carbon-carbon bonds of the bi- to tetravalent aliphatic hydrocarbon groups is linked to the 2 to 4 hindered phenol rings, and 3) an antioxidant having 2 to 4 hindered phenol rings and one benzene ring (an unsubstituted benzene ring or a substituted benzene ring having an alkyl group or the like substituted therein) or an isocyanurate ring, in which the 2 to 4 hindered phenol rings are each linked to the benzene ring or the isocyanurate ring via an alkylene group.

Specifically, from the viewpoint of prevention of ghosting, an antioxidant represented by the following formula (HP) is preferable as the hindered phenol antioxidant.

(HP)

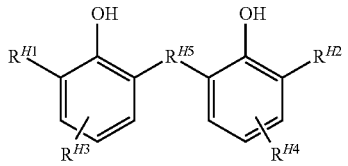

In formula (HP), $R^{H1}$ and $R^{H2}$ each independently represent a branched alkyl group having 4 to 8 carbon atoms.

$R^{H3}$ and $R^{H4}$ each independently represent a hydrogen atom, or an alkyl group having 1 to 10 carbon atoms.

$R^{H5}$ represents an alkylene group having 1 to 10 carbon atoms.

In formula (HP), examples of the alkyl groups represented by $R^{H1}$ and $R^{H2}$ include a branched alkyl group having 4 to 8 carbon atoms (preferably having 4 to 6 carbon atoms).

Specific examples of the branched alkyl group include an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, and a tert-octyl group.

Among these, a tert-butyl group and a tert-pentyl group are preferable, and a tert-butyl group is more preferable as the alkyl group.

In formula (HP), examples of $R^{H3}$ and $R^{H4}$ include a linear or branched alkyl group having 1 to 10 carbon atoms (preferably having 1 to 4 carbon atoms).

Specific examples of the linear alkyl group include a methyl group, an ethyl group, a n-propyl group, a n-butyl group, a n-pentyl group, a n-hexyl group, a n-heptyl group, a n-octyl group, a n-nonyl group, and a n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group and an ethyl group are preferable as the alkyl group.

In formula (HP), $R^{H5}$ represents a linear or branched alkylene group having 1 to 10 carbon atoms (preferably having 1 to 4 carbon atoms).

Specific examples of the linear alkylene group include a methylene group, an ethylene group, a n-propylene group, a n-butylene group, a n-pentylene group, a n-hexylene group, a n-heptylene group, a n-octylene group, a n-nonylene group, and a n-decylene group.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, and a tert-decylene group.

Among these, lower alkylene groups such as a methylene group, an ethylene group, and a butylene group are preferable as the alkylene group.

Furthermore, in formula (HP), examples of the respective substituents represented by $R^{H1}$, $R^{H2}$, $R^{H3}$, $R^{H4}$, and $R^{H5}$ include groups further having substituents. Examples of the substituent include halogen atoms (for example, a fluorine atom and a chlorine atom), alkoxy groups (for example, an alkoxy group having 1 to 4 carbon atoms), and aryl groups (for example, a phenyl group and a naphthyl group).

In formula (HP), particularly from the viewpoint of prevention of ghosting, it is preferable that $R^{H1}$ and $R^{H2}$ represent a tert-butyl group, and it is more preferable that $R^{H1}$ and $R^{H2}$ represent a tert-butyl group, $R^{H3}$ and $R^{H4}$ represent an alkyl group having 1 to 3 carbon atoms (particularly a methyl group), and $R^{H5}$ represents an alkylene group having 1 to 4 carbon atoms (particularly a methylene group).

Specifically, it is particularly preferable that the hindered phenol antioxidant is a hindered phenol antioxidant represented by an exemplary compound (HP-3).

The molecular weight of the hindered phenol antioxidant is preferably from 300 to 1,000, more preferably from 300 to 900, and still more preferably from 300 to 800, from the viewpoint of prevention of ghosting.

Specific examples of the hindered phenol antioxidant that may be used in the exemplary embodiment are shown below, but are not limited thereto.

(HP-1)

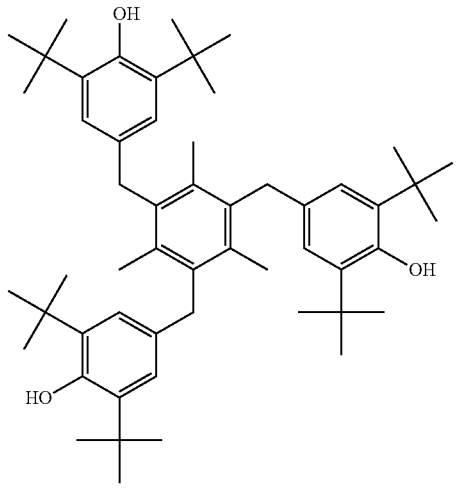

(HP-2)

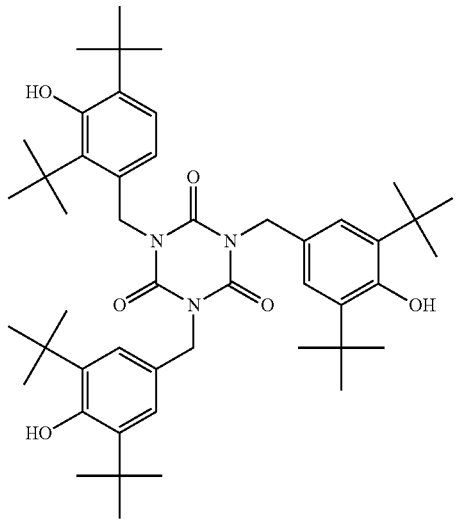

(HP-3)

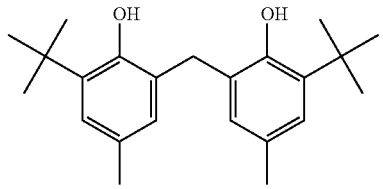

(HP-4)

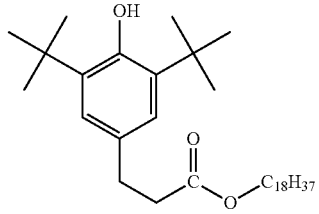

-continued (HP-5)

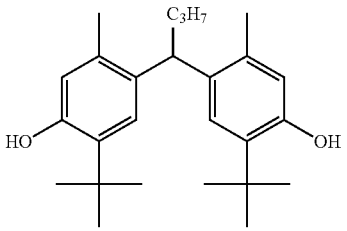

(HP-6)

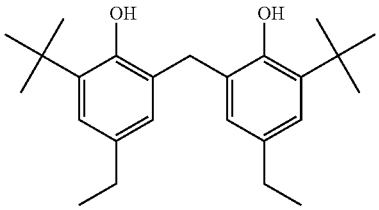

(HP-7)

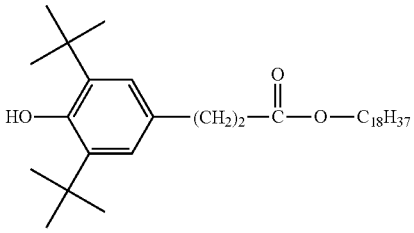

(HP-8)

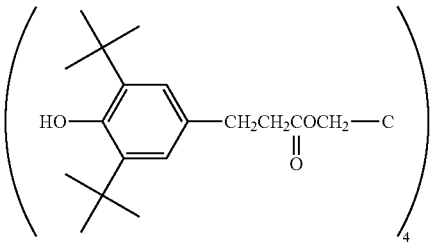

(HP-9)

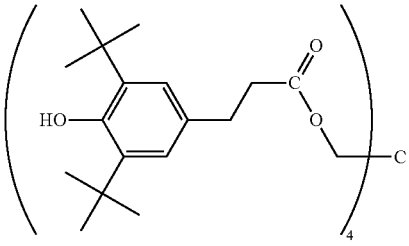

(HP-10)

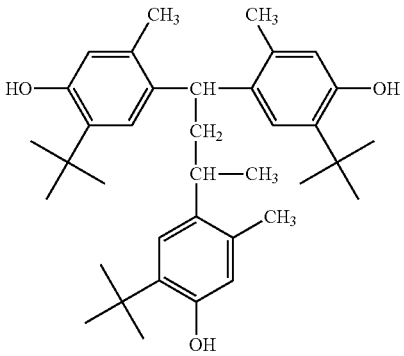

-continued (HP-11)

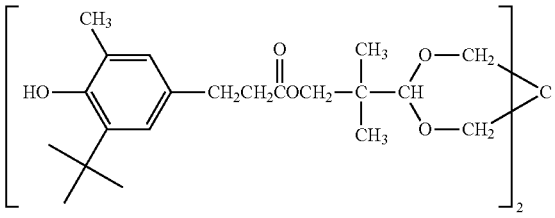

The hindered phenol antioxidant may be used alone or in combination of two or more kinds thereof.

Next, the benzophenone ultraviolet absorber will be described.

The benzophenone ultraviolet absorber is compound having a benzophenone skeleton.

Examples of the benzophenone ultraviolet absorber include 1) a compound in which two benzene rings are unsubstituted, 2) a compound in which two benzene rings are each independently substituted with at least one substituent selected from the group consisting of a hydroxyl group, a halogen atom, an alkyl group, an alkoxy group, and an aryl group. Particularly, the benzophenone ultraviolet absorber is preferably a compound in which one of two benzene rings is substituted with at least a hydroxyl group (in particular, at an ortho position with respect to a —C(=O)— group).

Specifically, an ultraviolet absorber represented by the following formula (BP) is preferable as the benzophenone ultraviolet absorber from the viewpoint of prevention of ghosting.

(BP)

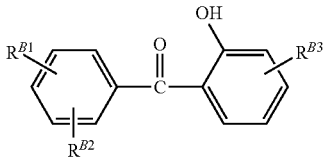

In formula (BP), $R^{B1}$, $R^{B2}$, and $R^{B3}$ each independently represent a hydrogen atom, a halogen atom, a hydroxyl group, an alkyl group having 1 to 10 carbon atoms, an alkoxy group having 1 to 10 carbon atoms, or an aryl group having 6 to 10 carbon atoms.

In formula (BP), examples of the halogen atom represented by $R^{B1}$, $R^{B2}$, and $R^{B3}$ include a fluorine atom, a chlorine atom, a bromine atom, and an iodine atom. Among these, a fluorine atom and a chlorine atom are preferable, and a chlorine atom is more preferable as the halogen atom.

In formula (BP), examples of the alkyl group represented by $R^{B1}$, $R^{B2}$, and $R^{B3}$ include a linear or branched alkyl group having 1 to 10 carbon atoms (preferably having 1 to 6 carbon atoms, and more preferably having 1 to 4 carbon atoms).

Specific examples of the linear alkyl group include methyl group, an ethyl group, a n-propyl group, a n-butyl group, a n-pentyl group, a n-hexyl group, a n-heptyl group, a n-octyl group, a n-nonyl group, and a n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups such as a methyl group, an ethyl group, and an isopropyl group are preferable as the alkyl group.

In formula (BP), examples of the alkoxy groups represented by $R^{B1}$, $R^{B2}$, and $R^{B3}$ include a linear or branched alkoxy group having 1 to 10 carbon atoms (preferably having 1 to 6 carbon atoms, and more preferably having 1 to 4 carbon atoms).

Specific examples of the linear alkoxy group include a methoxy group, an ethoxy group, a n-propoxy group, a n-butoxy group, a n-pentyloxy group, a n-hexyloxy group, a n-heptyloxy group, a n-octyloxy group, a n-nonyloxy group, and a n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is preferable as the alkoxy group.

In formula (BP), examples of the aryl groups represented by $R^{B1}$, $R^{B2}$, and $R^{E3}$ include an aryl group having 6 to 10 carbon atoms (preferably having 6 to 9 carbon atoms, and more preferably having 6 to 8 carbon atoms).

Specific examples of the aryl group include a phenyl group and a naphthyl group.

Among these, a phenyl group is preferable as the aryl group.

Furthermore, in formula (BP), the respective substituents represented by $R^{B1}$, $R^{B2}$, and $R^{B3}$ also include groups further having substituents. Examples of the substituents include atoms and groups exemplified above (for example, a halogen atom, an alkyl group, an alkoxy group, and an aryl group).

In formula (BP), particularly from the viewpoint of prevention of ghosting, it is preferable that at least one of $R^{B1}$, $R^{B2}$, and $R^{B3}$ represents an alkoxy group having 1 to 3 carbon atoms.

For example, a benzophenone ultraviolet absorber represented by the following Structural formula is particularly preferable.

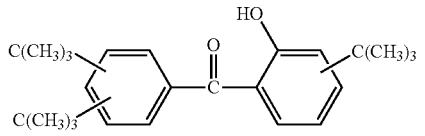

Specific examples of the benzophenone ultraviolet absorber (benzophenone ultraviolet absorber represented by formula (BP)) are shown below, but are not limited thereto.

| Exemplary compound No. | $R^{B1}$ | $R^{B2}$ | $R^{B3}$ |
|---|---|---|---|
| BP-1 | H | H | 4-OH |
| BP-2 | H | H | 4-$(CH_2)_7$—$CH_3$ |
| BP-3 | H | H | 4-$OCH_3$ |
| BP-4 | H | H | H |
| BP-5 | H | 3-$CH_3$ | 4-OH |
| BP-6 | H | 3-$CH_3$ | 4-$(CH_2)_7$—$CH_3$ |
| BP-7 | H | 3-$CH_3$ | 4-$OCH_3$ |
| BP-8 | H | 3-$CH_3$ | H |
| BP-9 | H | 4-$CH_3$ | 4-OH |
| BP-10 | H | 4-$CH_3$ | 4-$(CH_2)_7$—$CH_3$ |
| BP-11 | H | 4-$CH_3$ | 4-$OCH_3$ |
| BP-12 | H | 4-$CH_3$ | H |
| BP-13 | 2-$CH_3$ | 4-$CH_3$ | 4-OH |
| BP-14 | 2-$CH_3$ | 4-$CH_3$ | 4-$(CH_2)_7$—$CH_3$ |
| BP-15 | 2-$CH_3$ | 4-$CH_3$ | 4-$OCH_3$ |
| BP-16 | 2-$CH_3$ | 4-$CH_3$ | H |
| BP-17 | H | 3-$C_2H_5$ | 4-OH |
| BP-18 | H | 3-$C_2H_5$ | 4-$(CH_2)_7$—$CH_3$ |
| BP-19 | H | 3-$C_2H_5$ | 4-$OCH_3$ |
| BP-20 | H | 3-$C_2H_5$ | H |
| BP-21 | H | 4-$C_2H_5$ | 4-OH |
| BP-22 | H | 4-$C_2H_5$ | 4-$(CH_2)_7$—$CH_3$ |
| BP-23 | H | 4-$C_2H_5$ | 4-$OCH_3$ |
| BP-24 | H | 4-$C_2H_5$ | H |
| BP-25 | —$C(CH_3)_3$ | —$C(CH_3)_3$ | —$C(CH_3)_3$ |

Furthermore, the abbreviated symbols in the exemplary compounds represent the following meanings. Further, the numbers attached before the substituents represent the substitution positions with respect to the benzene ring.

—$CH_3$: Methyl group
—$C_2H_5$: Ethyl group
—$(CH_2)_7$—$CH_3$: Octyl group
—$OCH_3$: Methoxy group
—OH: Hydroxy group
—$C(CH_3)_3$: tert-Butyl group The benzophenone ultraviolet absorber may be used alone or in combination of two or more kinds thereof.

Next, the contents of the charge transport material, the antioxidant, and the ultraviolet absorber will be described.

With regard to the content of the butadiene charge transport material (CT1), from the viewpoint of obtaining a photosensitive layer (charge transport layer) having high charge transportability, it is preferable that, the blend ratio of the butadiene charge transport material (CT1) to the binder resin (weight ratio CT1:binder resin) is preferably in the range from 0.1:9.9 to 4.0:6.0, more preferably in the range from 0.4:9.6 to 3.5:6.5, and still more preferably in the range from 0.6:9.4 to 3.0:7.0.

Moreover, charge transport materials other than the butadiene charge transport material (CT1) and the benzidine charge transport material (CT2) may also be used in combination with others. Here, in such a case, the content of the charge transport materials with respect to all the charge transport materials is preferably equal to or less than 10% by weight (preferably equal to or less than 5% by weight).

The content of the hindered phenol antioxidant is preferably from 0.5% by weight to 30.0% by weight, more preferably from 0.5% by weight to 15% by weight, and still more preferably from 0.5% by weight to 9.0% by weight, with respect to 100% by weight of the total amount of the charge transport materials, from the viewpoint of prevention of ghosting. Further, the content of this hindered phenol antioxidant is expressed in parts (parts by weight) when the content of all the charge transport materials is defined as 100 parts by weight.

The content of the benzophenone ultraviolet absorber is preferably from 0.5% by weight to 30.0% by weight, more preferably from 0.5% by weight to 15% by weight, and still more preferably from 0.5% by weight to 9.0% by weight, with respect to 100% by weight of the total amount of the charge transport materials, from the viewpoint of prevention of ghosting. Further, the content of this benzophenone ultraviolet absorber is expressed in parts (parts by weight) when the content of all the charge transport materials is defined as 100 parts by weight.

Moreover, by setting the content of the hindered phenol antioxidant and the benzophenone ultraviolet absorber to equal to or less than 30.0% by weight, the decrease in the charge transportability of the charge transport materials by the antioxidant and the ultraviolet absorber is prevented. That is, prevention of the formation of an electrostatic latent image on the surface of the photoreceptor by irradiation with light is reduced, and thus, an image having a desired density is easily obtained.

Examples of the binder resin for use in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins or polyarylate resins are suitable as the binder resin. These resins may be used alone or in combination of two or more kinds thereof.

In addition, the blend ratio of the charge transport material to the binder resin is preferably from 10:1 to 1:5 in terms of weight ratio.

The charge transport layer may contain other known additives.

A technique for forming the charge transport layer is not particularly limited, and known forming methods are used. For example, formation of the charge transport layer is carried out by forming a coating film of a coating liquid for forming a charge transport layer that has been prepared by adding the components to a solvent, and then drying the coating film, followed by heating as desired.

Examples of the solvent for preparing the coating liquid for forming a charge transport layer are common organic solvents including, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or as a mixture of two or more kinds thereof.

Examples of a coating method used in coating the charge generation layer with the coating liquid for forming a charge transport layer include common methods such as a blade coating method, a wire bar coating method, a spray coating method, a dipping coating method, a bead coating method, an air knife coating method, and a curtain coating method.

The film thickness of the charge transport layer is, for example, set to be in the range from preferably 5 μm to 50 μm and more preferably from 10 μm to 30 μm.

Protective Layer

The protective layer is provided on the photosensitive layer, as desired. The protective layer is provided, for example, for the purpose of preventing the chemical changes of the photosensitive layer during charging, and further improving the mechanical strength of the photosensitive layer.

Accordingly, as the protective layer, a layer formed of a cured film (crosslinked film) may be applied. Examples of this layer include the layers described in 1) and 2) below.

1) A layer formed of a cured film of a composition that includes a reactive group-containing charge transport material that has a reactive group and a charge transporting skeleton in the same molecule (that is, a layer that includes a polymer or a crosslinked product of the reactive group-containing charge transport material)

2) A layer formed of a cured film of a composition that includes an unreactive charge transport material and a reactive group-containing non-charge transport material that has no charge transporting skeleton but has a reactive group (that is, a layer that includes a polymer or a crosslinked product of an unreactive charge transport material and a reactive group-containing non-charge transport material).

Examples of the reactive group of the reactive group-containing charge transport material include known reactive groups such as a chain polymerizable group, an epoxy group, —OH, —OR (where R represents an alkyl group), $—NH_2$, —SH, —COOH, and $—SiR^{Q1}{}_{3-Qn}(OR^{Q2})_{Qn}$ (where $R^{Q1}$ represents a hydrogen atom, an alkyl group, or a substituted or unsubstituted aryl group, $R^{Q2}$ represents a hydrogen atom, an alkyl group, or a trialkylsilyl group, and Qn represents an integer of 1 to 3).

The chain polymerizable group is not particularly limited as long it is a radically polymerizable functional group. For example, it is a functional group which has at least a group containing a carbon-carbon double bond. Specific examples thereof include a group that contains at least one selected from the group consisting of a vinyl group, a vinyl ether group, a vinyl thioether group, a styryl group, a vinylphenyl group, an acryloyl group, a methacryloyl group, and derivatives thereof. Among these, a group that contains at least one selected from the group consisting of a vinyl group, a styryl group, a vinylphenyl group, an acryloyl group, a methacryloyl group, and derivatives thereof is preferable as the chain polymerizable group from the viewpoint of its excellent reactivity.

The charge transporting skeleton of the reactive group-containing charge transport material is not particularly limited as long as it is a known structure for an electrophotographic photoreceptor. Examples thereof include structures derived from nitrogen-containing hole transport compounds such as triarylamine compounds, benzidine compounds, and hydrazone compounds, in which the skeleton is conjugated with a nitrogen atom. Among these, a triarylamine skeleton is preferable.

The reactive group-containing charge transport material having a reactive group and a charge transporting skeleton, the unreactive charge transport material, and the reactive group-containing non-charge transport material may be selected from known materials.

The protective layer may further include other known additives.

A technique for forming the protective layer is not particularly limited, and known methods are used. For example, the formation is carried out by forming a coating film from a coating liquid for forming a protective layer, which has been prepared by adding the components to a solvent, and drying the coating liquid, followed by a curing treatment such as heating, as desired.

Examples of the solvent used for preparing the coating liquid for forming a protective layer include aromatic solvents such as toluene and xylene; ketone solvents such as methyl ethyl ketone, methyl isobutyl ketone, and cyclohexanone; ester solvents such as ethyl acetate and butyl acetate; ether solvents such as tetrahydrofuran and dioxane; cellosolve solvents such as ethylene glycol monomethyl ether; and alcohol solvents such as isopropyl alcohol and butanol. These solvents may be used alone or as a mixture of two or more kinds thereof.

Furthermore, the coating liquid for forming a protective layer may be a solvent-free coating liquid.

Examples of the coating method used for coating the photosensitive layer (for example, the charge transport layer) with the coating liquid for forming a protective layer include common methods such as a dipping coating method, an extrusion coating method, a wire bar coating method, a spray coating method, a blade coating method, a knife coating method, and a curtain coating method.

The film thickness of the protective layer is set to be, for example, preferably in the range from 1 μm to 20 μm, and more preferably in the range from 2 μm to 10 μm.

Single-Layer Photosensitive Layer

A single-layer photosensitive layer (charge generating/charge transport layer) is, for example, a layer including a charge generating material, a charge transport material, and at least one selected from the group consisting of a hindered phenol antioxidant and a benzophenone ultraviolet absorber, and as desired, a binder resin and other known additives. Further, these materials are the same as the materials described in the charge generation layer and the charge transport layer.

In addition, the content of the charge generating material in the single-layer photosensitive layer is preferably from 10% by weight to 85% by weight, and more preferably from 20% by weight to 50% by weight, with respect to the total solid content. Further, the content of the charge transport material in the single-layer photosensitive layer is preferably from 5% by weight to 50% by weight with respect to the total solid content.

A method for forming the single-layer photosensitive layer is the same as the method for forming the charge generation layer or the charge transport layer.

The film thickness of the single-layer photosensitive layer is, for example, preferably from 5 μm to 50 μm, and more preferably from 10 μm to 40 μm.

Intermediate Transfer Belt

The intermediate transfer belt 20 is in the form of a semi-conductive belt including polyimide, polyamide imide, polycarbonate, polyarylate, polyester, rubber, or the like, and has an electric field dependence of the volume resistivity of 0.003 or less (log Ω·cm)/V in a voltage range of from 500 V to 1,000 V.

The volume resistivity of the intermediate transfer belt 20 is measured by the following manner.

UR100 Probe (manufactured by Dia Instruments Co., Ltd.) and RESITABLE UFL (manufactured by Dia Instruments Co., Ltd.) are connected with Digital Electrometer 8340A (manufactured by Advantest Corporation), a belt to be measured is disposed between the probe and the table, the amount of currents flowing in the probe is measured when a voltage of 500 V, 750 V, or 1,000 V from Resitable is applied every 5 second, and a volume resistivity is calculated from the voltage, the current, the electrode area, and the belt thickness. Further, measurement is carried out in an environment of 22° C. and 55% RH.

Furthermore, the electric field dependence of the volume resistivity P (log Ω·cm/V) of the intermediate transfer belt at a voltage in the range from V1 (V) to V2 (V) is represented by the following formula (1).

$$P=(R2-R1)/(V2-V1) \quad (1)$$

R1 represents the volume resistivity (log Ω·cm) of the intermediate transfer belt when a transfer voltage V1 (V) is applied to the intermediate transfer belt, and R2 represents the volume resistivity (log Ω·cm) of the intermediate transfer belt when a transfer voltage V2 (V) is applied to the intermediate transfer belt.

In the exemplary embodiment, in the case of V1=500 V and V2=750 V, and the case of V1=750 V and V2=1,000 V, an intermediate transfer belt whose electric field dependence P calculated by formula (1) is 0.003 or less (log Ω·cm)/V is used in each case.

Furthermore, a transfer voltage from 500 V to 1,000 V is a transfer voltage that is general in an image forming apparatus, and may also be applied in the image forming apparatus according to the exemplary embodiment.

The intermediate transfer belt in the exemplary embodiment preferably has an electric field dependence of the volume resistivity in a voltage range of from 500 V to 1,000 V of 0.0010 (log Ω·cm)/V to 0.0028 (log Ω·cm)/V, from the viewpoint of preventing the occurrence of ghosting.

A method for preparing the intermediate transfer belt in the exemplary embodiment, that is, an intermediate transfer belt having an electric field dependence of the volume resistivity of 0.003 or less (log Ω·cm)/V in a voltage range of from 500 V to 1,000 V is not particularly limited, but a polyimide endless belt obtained by imidizing a coating film in a cylindrical shape that has been formed with a polyimide precursor solution including a polyamic acid composition including a polyamic acid and carbon black is preferable. In this case, it is possible to prepare an endless belt (intermediate transfer belt) having an electric field dependence of the volume resistivity within the above range by increasing the dispersibility of carbon black. Specifically, it is preferably to use a polyimide precursor solution including a polyamic acid composition of the following first embodiment and a polyamic acid composition of the following second embodiment.

Polyamic Acid Composition of First Embodiment

The polyamic acid composition of the first embodiment is configured to include a polyamic acid in which the ratio Y/X of the total molar amount (Y) of terminal carboxy groups to the total molar amount (X) of terminal amino groups and terminal carboxy groups (hereinafter also referred to as a ratio Y/X of the total molar amount (Y) of terminal carboxy groups to the total molar amount (X) of terminal amino groups) is $0 \leq Y/X < 0.4$; carbon black at a pH of less than 7 in the amount from 10% by weight to 80% by weight with respect to the total solid content; and a solvent. In addition, the polyamic acid in the first embodiment is a polymer of a carboxylic dianhydride and a diamine compound, and a polyamic acid whose terminal is not capped with a carboxylic monoanhydride. Hereinafter, the carbon black at a pH of less than 7 is also referred to as "acidic carbon black".

Polyamic Acid

The polyamic acid composition of the first embodiment contains a polyamic acid in which the ratio Y/X of the total molar amount (Y) of terminal carboxy groups to the total molar amount (X) of terminal amino groups is $0 \leq Y/X < 0.4$. Further, examples of the "terminal carboxy group" include a terminal anhydrous carboxy group in which two carboxy groups are dehydrated.

The polyamic acid is a precursor of a polyimide and is a polymer compound having an amide bond (—NH—CO—) and a carboxy group in the same repeating unit.

At least one of the polyamic acids according to the first embodiment may have an amino group at the terminal of a molecular chain (main chain) including a repeating unit having an amide bond and a carboxy group, and may have a carboxy group at the terminal of a molecular chain (main chain) including a repeating unit having an amide bond and a carboxy group if the ratio Y/X of the total molar amount (Y) of terminal carboxy groups to the total molar amount (X) of terminal amino groups in all the polyamic acids in the polyamic acid composition is $0 \leq Y/X < 0.4$. Further, the main chain portion of the polyamic acid is not particularly limited as long as it has a structure including a repeating unit having both of an amide bond and a carboxy group.

As described above, the polyamic acids are usually classified into polyamic acids in which amino groups are at both of the terminals (hereinafter also referred to as "DA"), polyamic acids in which carboxy groups are at both terminals (hereinafter also referred to as "DC"), and polyamic acids in which an amino group is at one terminal and a carboxy group is at the other terminal (hereinafter also referred to as "AC").

Here, in the case where all kinds of DA, DC, and AC polyamic acids are included in the polyamic acid composition, the total molar amount (X) of the terminal amino groups in all the polyamic acids in the polyamic acid composition refers to a total molar amount of the terminal amino groups present at both terminals of DA and the terminal amino groups present at one terminal of AC. That is, the total molar amount (X) of the terminal amino groups refers to the amount (molar amount) of all the terminal amino groups of polyamic acids having terminal amino groups in the polyamic acid composition.

The total molar amount (X) of the terminal amino groups is measured by subjecting the polyamic acid composition to neutralization titration using an acid (for example, hydrochloric acid).

These also apply to the total molar amount (Y) of the terminal carboxy groups in all the polyamic acids in the polyamic acid composition.

In the case where all kinds of DA, DC, and AC polyamic acids are included in the polyamic acid composition, the total molar amount (Y) of the terminal carboxy groups in all the polyamic acids refers to a total molar amount of the terminal carboxy groups present at both terminals of DC and the terminal carboxy groups present at one terminal of AC. That is, the total molar amount (Y) of the terminal carboxy groups refers to the amount (molar amount) of all the terminal carboxy groups of polyamic acids having terminal carboxy groups in the polyamic acid composition.

The total molar amount (Y) of the terminal carboxy groups is measured by subjecting the polyamic acid composition to neutralization titration using a base (for example, sodium hydroxide).

The ratio Y/X of the total molar amount (Y) of the terminal carboxy groups to the total molar amount (X) of the terminal amino groups is a ratio of Y to X, obtained from the above two neutralization titration.

The Y/X preferably satisfies $0 \leq Y/X < 0.4$, and more preferably satisfies $0 \leq Y/X \leq 0.3$, from the viewpoint of the dispersibility of acidic carbon black. On the other hand, the Y/X preferably satisfies $0.1 \leq Y/X < 0.4$, and more preferably satisfies $0.2 \leq Y/X < 0.4$, from the viewpoint of the pot life of the polyamic acid composition.

Furthermore, the content of all the polyamic acids in the polyamic acid composition is preferably from 10% by weight to 80% by weight, more preferably from 20% by weight to 40% by weight, with respect to the total solid content of the polyamic acid composition, from the viewpoint of the dispersibility with acidic carbon black.

Preferable range of the weight average molecular weight (Mw) of the polyamic acids varies depending on the applications of polyimide obtained by heating the polyamic acids, followed by dehydration and condensation. Generally, the weight average molecular weight (Mw) is from 27,000 to 39,000, and for example, in the case where the polyamic acid composition is used for the preparation of an endless belt for use in the intermediate transfer member of the image forming apparatus, it is preferably equal to or less than 33,000, and more preferably equal to or less than 30,000.

Generally, the polyamic acid is synthesized by polymerizing a tetracarboxylic dianhydride or a derivatives thereof with a diamine compound in equivalent moles, and thus, polyamic acids (DA) in which amino groups are at both terminals, polyamic acids (DC) in which carboxy groups are at both terminals, and polyamic acids (AC) in which an amino group is at one terminal and a carboxy group is at the other terminal are obtained at DA:DC:AC=2:2:1 (on the molar basis).

As the tetracarboxylic dianhydride and the diamine compound which may be used for the synthesis of polyamic acids, for example, the following ones may be used.

Tetracarboxylic Dianhydride

The tetracarboxylic dianhydride is not particularly limited as long as it is a compound having two structures (—CO—O—CO—) derived from a carboxylic anhydride in the molecular structure, and any compound of an aromatic compound and an aliphatic compound may be used without particular limitation.

Examples of the tetracarboxylic dianhydride include those represented by the following formula (I).

Formula (I)

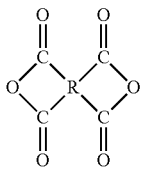

In formula (I), R is a tetravalent organic group, an aromatic, aliphatic, or cyclic aliphatic group, an aromatic and aliphatic group, or a substituted group thereof.

Examples of the aromatic tetracarboxylic dianhydride include pyromellitic dianhydride, 3,3',4,4'-benzophenonetetracarboxylic dianhydride, 3,3',4,4'-biphenylsulfonetetracarboxylic dianhydride, 1,4,5,8-naphthalenetetracarboxylic dianhydride, 2,3,6,7-naphthalenetetracarboxylic dianhydride, 3,3',4,4'-biphenyl ethertetracarboxylic dianhydride, 3,3',4,4'-dimethyldiphenylsilanetetracarboxylic dianhydride, 3,3',4,4'-tetraphenylsilanetetracarboxylic dianhydride, 1,2,3,4-furantetracarboxylic dianhydride, 4,4'-bis(3,4-dicarboxyphenoxy)diphenylsulfide dianhydride, 4,4'-bis(3,4-dicarboxyphenoxy)diphenylsulfone dianhydride, 4,4'-bis(3,4-dicarboxyphenoxy)diphenylpropane dianhydride, 3,3',4,4'-perfluoroisopropylidenediphthalic dianhydride, 3,3',4,4'-biphenyl tetracarboxylic dianhydride, bis(phthalic acid) phenylphosphine oxide dianhydride, p-phenylene-bis(triphenylphthalic acid)dianhydride, m-phenylene-bis(triphenylphthalic acid)dianhydride, bis(triphenylphthalic acid)-4,4'-diphenyl ether dianhydride, and bis(triphenylphthalic acid)-4,4'-diphenylmethane dianhydride.

Examples of the aliphatic tetracarboxylic dianhydride include aliphatic or alicyclic tetracarboxylic dianhydrides such as butanetetracarboxylic dianhydride, 1,2,3,4-cyclobutanetetracarboxylic dianhydride, 1,3-dimethyl-1,2,3,4-cyclobutanetetracarboxylic dianhydride, 1,2,3,4-cyclopentanetetracarboxylic dianhydride, 2,3,5-tricarboxycyclopentylacetic dianhydride, 3,5,6-tricarboxynorbornane-2-acetic dianhydride, 2,3,4,5-tetrahydrofurantetracarboxylic dianhydride, 5-(2,5-dioxotetrahydrofuryl)-3-methyl-3-cyclohexene-1,2-di carboxylic dianhydride, and bicyclo[2,2,2]-oct-7-ene-2,3,5,6-tetracarboxylic dianhydride; and aromatic ring-containing aliphatic tetracarboxylic dianhydrides such as 1,3,3a,4,5,9b-hexahydro-5-(tetrahydro-2,5-dioxo-3-furanyl)-naphtho[1,2-c]furan-1,3-dione, 1,3,3a,4,5,9b-hexahydro-5-methyl-5-(tetrahydro-2,5-dioxo-3-furanyl-naphtho[1,2-c]furan-1,3-dione, and 1,3,3a,4,5,9b-hexahydro-8-methyl-5-(tetrahydro-2,5-dioxo-3-furanyl)-naphtho[1,2-c]furan-1,3-dione.

As the tetracarboxylic dianhydride, an aromatic tetracarboxylic dianhydride is preferable, and pyromellitic dianhydride, 3,3',4,4'-benzophenonetetracarboxylic dianhydride, or 3,3',4,4'-biphenylsulfonetetracarboxylic dianhydride is more preferable.

These tetracarboxylic dianhydrides may be used alone or in combination of two or more kinds thereof.

Diamine Compounds

The diamine compound is not particularly limited as long as it is a diamine compound having two amino groups in the molecular structure.

Examples of the diamine compound include aromatic diamines such as p-phenylenediamine, m-phenylenediamine, 4,4'-diaminodiphenylmethane, 4,4'-diaminodiphenylethane, 4,4'-diaminodiphenyl ether, 4,4'-diaminodiphenylsulfide, 4,4'-diaminodiphenylsulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenyl ether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl] propane, 2,2-bis[4-(4-aminophenoxy)phenyl] hexafluoropropane, 1,4-bis(4-aminophenoxy)benzene, 4,4'-bis(4-aminophenoxy)-biphenyl, 1,3'-bis(4-aminophenoxy) benzene, 9,9-bis(4-aminophenyl)fluorene, 4,4'-(p-phenyleneisopropylidene)bisaniline, 4,4'-(m-phenyleneisopropylidene)bisaniline, 2,2'-bis[4-(4-amino-2-trifluoromethylphenoxy)phenyl]hexafluoropropane, and 4,4'-bis[4-(4-amino-2-trifluoromethyl)phenoxy]-octafluorobiphenyl; aromatic diamines having two amino groups bound to an aromatic ring and a heteroatom other than the nitrogen atoms of the amino groups such as diaminotetraphenylthiophene; and aliphatic diamines and alicyclic diamines such as 1,1-metaxylylenediamine, 1,3-propanediamine, tetramethylenediamine, pentamethylenediamine, octamethylenediamine, nonamethylenediamine, 4,4-diaminoheptamethylenediamine, 1,4-diaminocyclohexane, isophoronediamine, tetrahydrodicyclopentadienylenediamine, hexahydro-4,7-methanoindanylenedimethylenediamine, tricyclo[6,2,1,$0^{2,7}$]-undecylenedimethyldiamine, and 4,4'-methylenebis(cyclohexylamine).

As the diamine compound, p-phenylenediamine, 4,4'-diaminodiphenylmethane, 4,4'-diaminodiphenyl ether, 4,4'-diaminodiphenyl sulfide, or 4,4'-diaminodiphenylsulfone is preferable. These diamine compounds may be used alone or in combination of two or more kinds thereof.

Combination of Tetracarboxylic Dianhydride and Diamine Compound

As a combination of the tetracarboxylic dianhydride and the diamine compound, used for the synthesis of a polyamic acid, a combination of an aromatic tetracarboxylic dianhydride and an aromatic diamine is preferable.

The concentration of the polymeric solid contents during the synthesis (polymerization) of the polyamic acid is not particularly limited, but is preferably from 5% by weight to 50% by weight, and more preferably from 10% by weight to 30% by weight.

The polymerization temperature during the synthesis of the polyamic acid is preferably in the range from 0° C. to 80° C.

Solvent

The polyamic acid composition of the first embodiment contains at least one kind of solvent.

The solvent may be a dispersion medium in which acidic carbon black is dispersed in the polyamic acid composition.

Examples of the solvent include organic polar solvent, specifically sulfoxide solvents such as dimethylsulfoxide and diethylsulfoxide; formamide solvents such as N,N-dimethylformamide and N,N-diethylformamide; acetamide solvents such as N,N-dimethylacetamide and N,N-diethylacetamide; pyrrolidone solvents such as N-methyl-2-pyrrolidone and N-vinyl-2-pyrrolidone; phenol solvents such as phenol, o-, m- or p-cresol, xylenol, halogenated phenol, and catechol; ether solvents such as tetrahydrofuran, dioxane, and dioxolane; alcohol solvents such as methanol, ethanol, and butanol; cellosolve solvents such as butyl cellosolve; and hexamethylphosphoramide and γ-butyrolactone.

Among these, pyrrolidone solvents are preferable, and N-methyl-2-pyrrolidone (hereinafter also referred to as "NMP") is more preferable.

The solvent included in the polyamic acid composition may be used alone or as a mixture of two or more kinds thereof. Further, the content of the solvent in the polyamic acid composition is preferably from 70% by weight to 80% by weight, and more preferably 76% by weight to 78% by weight, with respect to the total amount of the polyamic acid composition, from the viewpoint of dispersibility of acidic carbon black.

Furthermore, the organic polar solvent is also used as a polymerization solvent used for the synthesis of a polyamic acid by reacting a tetracarboxylic dianhydride with a diamine compound, and the organic polar solvent is preferably used alone or as a mixture. As the polymerization solvent, an aromatic hydrocarbon such as xylene and toluene may be used. The polymerization solvent for the polyamic acid is not particularly limited as long as it dissolves the polyamic acid.

Acidic Carbon Black

The polyamic acid composition of the first embodiment contains carbon black (acidic carbon black) with a pH of less than 7 in the amount from 10% by weight to 80% by weight.

Acidic carbon black is prepared by subjecting carbon black to an oxidation treatment so as to impart a carboxyl group, a quinone group, a lactone group, or a hydroxy group to a surface thereof. This oxidation treatment is carried out by, for example, an air oxidizing method of contacting carbon black with air to react them in an atmosphere at a high temperature (for example, from 300° C. to 800° C.), a method of reacting with nitrogen oxide or ozone at a normal temperature (for example, 25° C., which shall apply hereinafter), or a method of carrying out air oxidation at a high temperature (for example, from 300° C. to 800° C.) and then carrying tout ozone oxidation at a low temperature (for example, from 20° C. to 200° C.).

Specifically, acidic carbon black is prepared by, for example, a contact method. Examples of the contact method include a channel method and a gas black method. Further, acidic carbon black may also be prepared by a furnace black method using a gas or oil as a raw material. Further, after these treatments are carried out, an oxidation treatment in an aqueous phase may be carried out with nitric acid or the like, as desired.

Incidentally, although acidic carbon black may be prepared by the contact method, this contact method is commonly carried out in accordance with a furnace method in a closed system. In the furnace method, only carbon black having high pH and a low volatile content is generally prepared, but the pH of this carbon black may be adjusted by subjecting it to the above-mentioned acid treatment in the aqueous phase. Thus, carbon black that is obtained by this furnace method and adjusted to a pH of less than 7 through the subsequent treatment may also be applied.

The pH value of acidic carbon black is less than 7, but the pH is preferably equal to or less than 4.4, and more preferably equal to or less than 4.0.

Here, the pH of acidic carbon black is determined by preparing an aqueous suspension of carbon black and measuring its pH with a glass electrode. The pH value of the acidic carbon black may be controlled by controlling conditions such as the treating temperature or the treating time in an oxidation treatment.

Acidic carbon black has a content of volatile components of, for example, preferably from 1% by weight to 25% by weight, more preferably from 2% by weight to 20% by weight, and still more preferably from 3.5% by weight to 15% by weight.

Specific examples of acidic carbon black include "PRINTEX 150T" (pH 4.5, volatile content 10.0%), "SPECIAL BLACK 350" (pH 3.5, volatile content 2.2%), "SPECIAL BLACK 100" (pH 3.3, volatile content 2.2%), "SPECIAL BLACK 250" (pH 3.1, volatile content 2.0%), "SPECIAL BLACK 5" (pH 3.0, volatile content 15.0%), "SPECIAL BLACK 4" (pH 3.0, volatile content 14.0%), "SPECIAL BLACK 4A" (pH 3.0, volatile content 14.0%), "SPECIAL BLACK 550" (pH 2.8, volatile content 2.5%), "SPECIAL BLACK 6" (pH 2.5, volatile content 18.0%), "COLOR BLACK FW200" (pH 2.5, volatile content 20.0%), "COLOR BLACK FW2" (pH 2.5, volatile content 16.5%), and "COLOR BLACK FW2V" (pH 2.5, volatile content 16.5%), all manufactured by Orion Engineered Carbons; and "MONARCH 1000" (pH 2.5, volatile content 9.5%), "MONARCH 1300" (pH 2.5, volatile content 9.5%), "MONARCH 1400" (pH 2.5, volatile content 9.0%), "MOGUL-L" (pH 2.5, volatile content 5.0%), and "REGAL 400R" (pH 4.0, volatile content 3.5%), all manufactured by Cabot Corporation.

The content of the acidic carbon black in the polyamic acid composition is from 10% by weight to 80% by weight, preferably from 20% by weight to 40% by weight, and more preferably from 22% by weight to 29% by weight, with respect to the total solid content of the composition.

Dispersant and Others

It is considered that acidic carbon black increases dispersibility by linking terminal amino groups of the polyamic acid as an excess fraction that is present in the polyamic acid composition, to hydrogen bonds, as described above, but in order to improve the dispersibility, the polyamic acid composition may further contain a dispersant.

The dispersant that may be used so as to disperse the acidic carbon black may be a low-molecular-weight one or a high-molecular-weight one, and as the dispersant, any kind of dispersant selected from cationic, anionic, and nonionic ones may be used. It is preferable to use a nonionic polymer as the dispersant.

Nonionic Polymer

Examples of the nonionic polymer include poly(N-vinyl-2-pyrrolidone), poly(N,N'-diethylacrylazide), poly(N-vinylformamide), poly(N-vinylacetamide), poly(N-vinylphthalamide), poly(N-vinylsuccinic amide), poly(N-vinylurea), poly(N-vinylpiperidone), poly(N-vinylcaprolactam), and poly(N-vinyloxazoline).

These nonionic polymers may be used alone or as a mixture of two or more kinds thereof. Among these, poly (N-vinyl-2-pyrrolidone) is preferable.

The blend content of the nonionic polymer in the polyamic acid composition is preferably from 0.2 parts by weight to 3 parts by weight with respect to 100 parts by weight of polyamic acid.

Method for Preparing Polyamic Acid Composition of First Embodiment

The polyamic acid composition of the first embodiment may be prepared as follows.

First, a polyamic acid solution that is a precursor of a polyimide resin is obtained by subjecting a tetracarboxylic dianhydride and a diamine compound to a polymerization reaction in a solvent. The polyamic acid solution is purified by precipitating a polyamic acid by the addition of a poor solvent such as methanol, and then reprecipitating the polyamic acid. The precipitated polyamic acid is separated by filtration and then re-dissolved into a solvent that dissolves polyamic acids, such as γ-butyrolactone, thereby obtaining a polyamic acid solution.

Next, acidic carbon black may be added to the obtained polyamic acid solution in an amount of, for example, from 20 parts by weight to 50 parts by weight with respect to 100 parts by dry weight of the polyamic acid resin.

Furthermore, in order to increase the dispersibility of acidic carbon black, the components in the polyamic acid solution may be mixed using physical methods such as stirring by a mixer or stirrer, or dispersion using a parallel roller or ultrasound. Further, examples of a technique for improving the dispersibility of the acidic carbon black include, but are not limited to, chemical methods such as introducing a dispersant.

Polyamic Acid Composition of Second Embodiment

The polyamic acid composition of second embodiment is configured to include a polyamic acid having amino groups at all the terminals, in which the ratio Z/X (hereinafter also referred to as the ratio Z/X of the total molar amount (Z) of the terminals at which terminal amino groups are capped with carboxylic monoanhydrides to the total molar amount (X) of the terminal amino groups not capped with carboxylic monoanhydrides) of the total molar amount (Z) of the terminal amino groups capped with carboxylic monoanhydrides to the total molar amount (X) of the terminal amino groups not capped with carboxylic monoanhydrides and the terminal amino groups capped with carboxylic monoanhydrides is $0 \leq Z/X < 0.4$; carbon black at a pH of less than 7 in the amount from 10% by weight to 80% by weight with respect to the total solid content; and a solvent.

The polyamic acid herein is, in one example, a polyamic acid synthesized as shown in the following scheme, or then capped with a carboxylic monoanhydride, as desired.

First, for example, a tetracarboxylic dianhydride or a derivative thereof and a diamine compound are reacted with the diamine compound being in an excess amount, thereby synthesizing a fully amine-terminated polyamic acid. Next, a carboxylic monoanhydride is reacted with a terminal amine group to cap the terminal amine group. Thus, a terminal capped with the carboxylic monoanhydride of the terminal amine group is obtained.

Z/X preferably satisfies $0 \leq Z/X < 0.4$, and more preferably satisfies $0 \leq Z/X \leq 0.3$, from the viewpoint of dispersibility of acidic carbon black. On the other hand, Z/X preferably satisfies $0.1 \leq Z/X < 0.4$, and more preferably satisfies $0.2 \leq Z/X < 0.4$, from the viewpoint of the pot life of the polyamic acid composition.

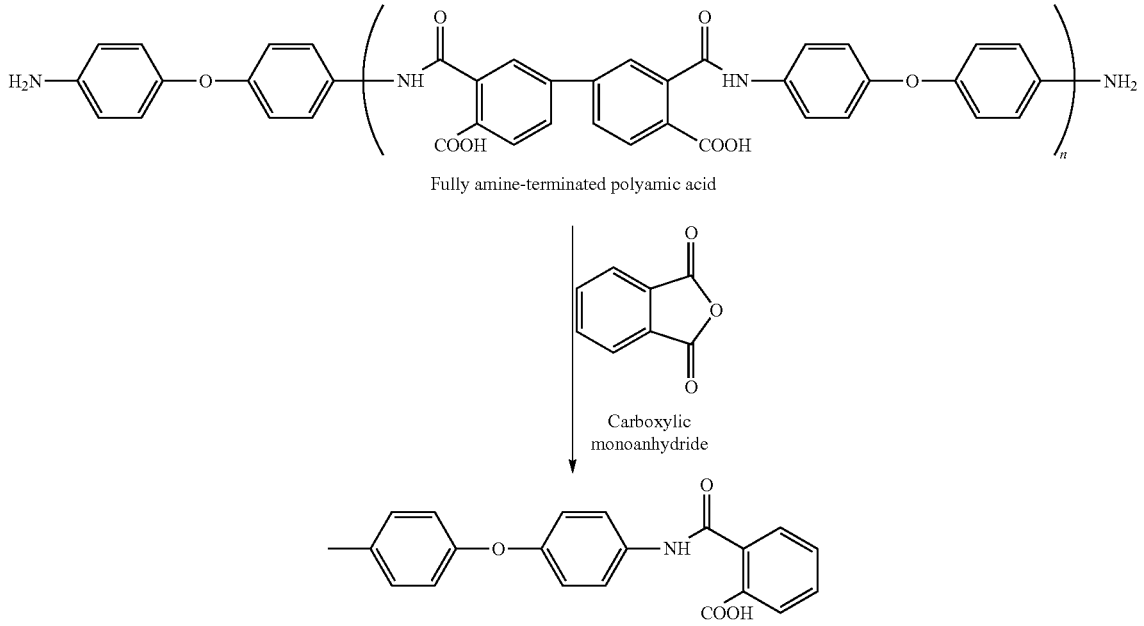

Furthermore, the total molar amount (X) of the terminal amino groups not capped with carboxylic monoanhydrides in all the polyamic acids in the polyamic acid composition refers to a total molar amount of the terminal amino groups which are not reacted with carboxy groups of the carboxylic monoanhydrides in the terminal amino groups present at both terminals of the polyamic acids (DA) having amino groups at both terminals.

The total molar amount (X) of the terminal amino groups is measured by subjecting the polyamic acid composition to neutralization titration using an acid (for example, hydrochloric acid).

On the other hand, the total molar amount (Z) of the terminals in which the terminal amino groups in all the polyamic acids in the polyamic acid composition are capped with the carboxylic monoanhydrides refers to the total molar amount of the terminals that have been reacted with carboxyl groups of the carboxylic monoanhydrides in the terminal amino groups present in both terminals of the polyamic acids (DA) having amino groups at both terminals.

The total molar amount (Z) of the terminals in all the polyamic acids in the polyamic acid composition is measured by neutralization titration using an acid (for example, hydrochloric acid).

That is, in the polyamic acid having amino groups at all the terminals, the ratio Z/X of the total molar amount (Z) of the terminals in which the terminal amino groups are capped with carboxylic monoanhydrides to the total molar amount (X) of the terminal amino groups that are not capped with carboxylic monoanhydrides is a ratio of Z to X obtained by the measurement method.

Here, the polyamic acid having amino groups at both terminals is obtained by synthesis through polymerization of a tetracarboxylic dianhydride or a derivative thereof with a diamine compound, in which the diamine compound is used in an excess amount.

Furthermore, in the polyamic acid having amino groups at both terminals, the carboxylic monoanhydrides that cap the terminal amino groups are cyclic carboxylic monoanhydrides having two carboxyl groups, in which these two carboxy groups undergo a dehydration/condensation reaction in the molecule.

Specific examples of the carboxylic monoanhydride include phthalic anhydride, maleic anhydride, 2,3-benzophenonedicarboxylic anhydride, 3,4-benzophenonedicarboxylic anhydride, 2,3-dicarboxyphenylphenyl ether anhydride, 3,4-dicarboxyphenylphenyl ether anhydride, 2,3-biphenyldicarboxylic anhydride, 3,4-biphenyldicarboxylic anhydride, 2,3-dicarboxyphenylphenylsulfone anhydride, 3,4-dicarboxyphenylphenylsulfone anhydride, 2,3-dicarboxyphenylphenylsulfide anhydride, 3,4-dicarboxyphenylphenylsulfide anhydride, 1,2-naphthalenedicarboxylic anhydride, 2,3-naphthalenedicarboxylic anhydride, 1,8-naphthalenedicarboxylic anhydride, 1,2-anthracenedicarboxylic anhydride, 2,3-anthracenedicarboxylic anhydride and 1,9-anthracenedicarboxylic anhydride. Among these, phthalic anhydride and maleic anhydride are preferable.

In addition, the carboxylic anhydrides are adjusted to a use amount (capped amount) in such a range to allow the Z/X to be within the above range.

The polyamic acid of the second embodiment as described above is the same as the polyamic acid composition of the first embodiment except for the above, and thus, the description thereof will be omitted.

The intermediate transfer belt in the exemplary embodiment is obtained by, for example, imidizing a coating film in a cylindrical shape that has been formed with a polyimide precursor solution including the polyamic acid composition according to the first or second embodiment. Further, in this case, the drying temperature of the coating film is preferably set to a range from 130° C. to 200° C.

In addition, the intermediate transfer belt may be configured to have another layer including a polyamide laminated therein, as desired.

Charging Device

The charging device is not limited to charging rollers 2Y, 2M, 2C, and 2K, and known chargers such as a contact-type charger using a brush, a film, a rubber blade, or the like, and a scorotron or corotron charger that utilizes corona discharge are widely used. Among these, the contact-type charger is preferable.

The charging device usually allow directs current to be applied to the photoreceptor 1Y, 1M, 1C, or 1K, but may further allow alternating current to be superimposedly applied thereto.

Exposure Device

The exposure device 3 is not particularly limited, and for example, known exposure devices such as an optical device capable of exposing the surface of the photoreceptor 1Y, 1M, 1C, or 1K to light from a light source such as semiconductor laser light, Light Emitting Diode (LED) light, or liquid crystal shutter light, or in an image pattern determined through a polygon mirror from the light source are widely applied.

Developing Device

A developing device 4Y, 4M, 4C, or 4K is selected according to a purpose, and examples thereof include known developers that perform development with a single-component developer or a two-component developer in a contact or non-contact manner, using a brush, a roller, or the like.

The developers for use in the developing devices 4Y, 4M, 4C, and 4K may be a single-component developer including a toner alone or a two-component developer including a toner and a carrier. Further, the developer may be magnetic or non-magnetic. As these developers, known ones are applied.

In addition, with a toner having a volume average particle diameter of the toner of equal to or less than 5.0 μm, a high-precision image is obtained, while an adhesive force is large, and thus transfer failure easily occurs. However, if the image forming apparatus according to the exemplary embodiment is used, occurrence of ghosting is prevented and occurrence of transfer failure is effectively prevented even when the volume average particle diameter of the toner is equal to or more than 5.0 μm.

Here, the volume average particle diameter of the toner corresponds to the volume average particle diameter of toner particles, for example, in the case of a toner including toner particles and an external additive.

The volume average particle diameter of the toner (toner particles) is measured in the following manner.

First, 0.5 mg to 50 mg of a measurement sample is added to 2 ml of an aqueous solution containing 5% of a surfactant (preferably sodium alkylbenzene sulfonate) as a dispersant. This solution is added to 100 ml to 150 ml of an electrolytic solution. The electrolytic solution in which the measurement sample is suspended is dispersed with an ultrasonic disperser for 1 minute. Then, a particle diameter distribution of particles having a particle diameter in a range from 2.0 μm to 60 μm is measured using COULTER MULTISIZER Type II (manufactured by Beckman Coulter, Inc.) and an aperture having an aperture diameter of 100 μm. The number of particles to be measured is 50,000.

For the obtained particle size range (channel) having particle size distribution gradated, a volume accumulation distribution is subtracted from a small particle diameter side, and the particle diameter at which the accumulation of the particle diameters reaches 50% is defined as a volume average particle diameter D50*v*.

In addition, due to a tendency that as the volume average particle diameter of the toner is smaller, the particles are hard to transfer, and the volume average particle diameter of the toner used in the exemplary embodiment is preferably equal to or more than 3.8 μm.

Primary Transfer Roller

Primary transfer rollers 5Y, 5M, 5C, and 5K may be a single-layer structure or a multilayer structure. For example, in the case of the single-layer structure, the primary transfer roller is formed of a roller in which a suitable amount of conductive particles such as carbon black has been blended in a foamed or non-foamed silicone rubber, urethane rubber, EPDM, or the like.

The primary transfer roller primarily transfers the toner image formed on the surface of the electrophotographic photoreceptor onto the intermediate transfer belt, and erases the charges on the surface of the electrophotographic photoreceptor by applying current (charge erasing bias) to the electrophotographic photoreceptor after the toner image of the electrophotographic photoreceptor onto the intermediate transfer belt and before charging.

Photoreceptor Cleaning Device

A photoreceptor cleaning device 6Y, 6M, 6C, or 6K is used to remove the residual toner attached onto the surface of the photoreceptor 1Y, 1M, 1C, or 1K after the primary transfer, and a cleaning blade, in addition to a cleaning brush, a cleaning roller, or the like, may be used. Among these, a cleaning blade is preferably used. Further, examples of the materials of the cleaning blade include urethane rubber, neoprene rubber, and silicone rubber.

Secondary Transfer Roller

The layer structure of the secondary transfer roller 26 is not particularly limited, but for example, in the case of a three-layer structure, the secondary transfer roller 26 is formed of a core layer, an intermediate layer, and a coating layer covering the surface. The core layer is a foamed member of silicone rubber, urethane rubber, EPDM or the like in which conductive particles have been dispersed. The intermediate layer is formed of a non-foamed member thereof. Examples of the material of the coating layer include a tetrafluoroethylene-hexafluoropropylene copolymer and a perfluoroalkoxy resin. The volume resistivity of the secondary transfer roller 26 is preferably equal to or less than $10^7$ Ωcm. Further, a two-layer structure, excluding the intermediate layer, may also be used.

Back-Up Roller

The back-up roller 24 forms a counter electrode of the secondary transfer roller 26. The layer structure of the back-up roller 24 may be a single-layer structure or a multilayer structure. For example, in the case of a single-layer structure, the back-up roller 24 is formed of a roller in which a suitable amount of conductive particles, such as carbon black, has been blended in silicone rubber, urethane rubber, EPDM, or the like. In the case of a two-layer structure, the back-up roller 24 is formed of a roller in which the outer circumferential surface of an elastic layer formed of a rubber material mentioned above has been covered with a high resistance layer.

Fixing Device

As a fixing device 4Y, 4M, 4C, or 4K, known fixing devices such as a heat roller fixing device, a pressure roller fixing device, and a flash fixing device are widely applied.

Cleaning Device for Intermediate Transfer Belt

As a cleaning device 30 for an intermediate transfer belt, a cleaning blade, in addition to a cleaning brush, a cleaning roller, or the like, may be used. Among these, a cleaning blade is preferably used. Further, examples of the materials of a cleaning blade include urethane rubber, neoprene rubber, and silicone rubber.

Moreover, even when the image forming apparatus according to the exemplary embodiment may not include a charge erasing device for an exclusively use, occurrence of ghosting is prevented, but in order to more reliably remove the residual potential remaining on the surface of the photoreceptor 1Y, 1M, 1C, or 1K after the transfer, a charge erasing device may be included.

Process Cartridge

According to the exemplary embodiment, the process cartridge is configured to be detachable from an image forming apparatus including an electrophotographic photoreceptor having an electroconductive substrate and a photosensitive layer that is provided on the electroconductive substrate and includes at least one selected from the group consisting of a hindered phenol antioxidant and a benzophenone ultraviolet absorber; and a transfer device that includes an intermediate transfer belt whose electric field dependence of the volume resistivity is 0.003 or less (log Ω·cm)/V in a voltage range of from 500 V to 1,000 V, and transfers the toner image formed on the surface of the electrophotographic photoreceptor onto a recording medium through the intermediate transfer belt and erases the charges on the surface of the electrophotographic photoreceptor by applying current to the electrophotographic photoreceptor after the toner image formed on the surface of the electrophotographic photoreceptor has been transferred onto the intermediate transfer belt.

By mounting the process cartridge according to the exemplary embodiment into an image forming apparatus including a transfer device that transfers the toner image formed on the surface of the electrophotographic photoreceptor onto a recording medium through the intermediate transfer belt, and erases the charges on the surface of the electrophotographic photoreceptor by applying transfer bias current to the electrophotographic photoreceptor after the toner image formed on the surface of the electrophotographic photoreceptor has been transferred onto the intermediate transfer belt, occurrence of ghosting is prevented even when a charge erasing device for an exclusively use is not included.

Furthermore, the process cartridge according to the exemplary embodiment is not limited to the configuration above, and may also be configured to include at least one selected from, for example, other devices such as a charging device, an electrostatic charge image forming device, and a developing device, as desired.

EXAMPLES

Hereinafter, Examples of the invention will be described, but the invention is not limited to the following Examples.

Preparation of Intermediate Transfer Belt

Synthesis of Polyamic Acid

A polyamic acid DA-A1 as a polyamic acid having amino groups at both terminals of the molecular chain, and a polyamic acid DC-A1 as a polyamic acid having carboxy groups at both terminals of the molecular chain are synthesized in accordance with the following methods.

Synthesis Example 1

Preparation of Polyamic Acid Solution DA-A1

83.48 g (416.9 millimoles) of 4,4'-diaminodiphenyl ether (hereinafter abbreviated as "ODA") as a diamine compound is added to 800 g of N-methyl-2-pyrrolidone (hereinafter abbreviated as "NMP"), and dissolved by stirring at a normal temperature (25° C.). Then, 116.52 g (396.0 millimoles) of 3,3',4,4' biphenyl tetracarboxylic dianhydride (hereinafter abbreviated as "BPDA") as a tetracarboxylic dianhydride is slowly added thereto. After the addition and dissolution of the tetracarboxylic dianhydride, the temperature of the reaction liquid is heated to 60° C., and the polymerization reaction is performed for 20 hours while maintaining the temperature of the reaction liquid at this temperature, thereby obtaining a reaction liquid containing the polyamic acid DA-A1 and NMP.

The obtained reaction liquid is filtered using a stainless steel mesh of #800 and is cooled to room temperature (25° C.), thereby obtaining a polyamic acid solution DA-A1 having a solution viscosity of 2.0 Pa·s at 25° C. Further, the solution viscosity of the polyamic acid solution is a value measured using an E type rotary viscometer, TV-20H, manufactured by Toki Sangyo Co., Ltd. with a standard rotor (1°34"× R24), under a measurement temperature of 25° C. and a rotation number of 0.5 rpm (equal to or more than 100 Pa·s) and 1 rpm (less than 100 Pa·s). The solution viscosity of the polyamic acid solution obtained in the following Synthesis Examples is also a value measured in the same manner.

Synthesis Example 2

Preparation of Polyamic Acid Solution DC-A1

A polyamic acid solution DC-A1 with a solution viscosity of 6.0 Pa·s, including the polyamic acid DC-A1 and NMP, is obtained in the same manner as in Synthesis Example 1 except that 79.57 g (397.4 millimoles) of ODA and 120.43 g (409.3 millimoles) of BPDA are used.

Preparation of Polyamic Acid Composition A1

| | |
|---|---|
| Polyamic acid solution DA-A1 including a polyamic acid DA-A1 | 700 g |
| Polyamic acid solution DC-A1 including a polyamic acid DC-A1 | 300 g |
| Acidic carbon black (in a dried state; conductive) (SPECIAL BLACK 6: manufactured by Orion Engineered Carbons, Ltd., pH 2.5, volatile content: 18.0%, hereinafter abbreviated as "SB-6") | 55.6 g |

The polyamic acid solution DA-A1 and the polyamic acid solution DC-A1 at the above composition are mixed, acidic carbon black SB-6 is subjected to a dispersion treatment by a ball mill at 30° C. for 12 hours to be dispersed in a mixed liquid of the polyamic acid solution. Thereafter, a mixed liquid in which SB-6 is dispersed therein is filtered through a #400 stainless mesh to obtain a polyamic acid composition A1 having the following composition.

The composition of the polyamic acid composition A1 is as follows: Solid contents (the sum of polyamic acids DA-A1 and DC-A1)/NMP/SB-6 of polyamic acid=185.4/814.6/55.6 (weight ratio).

The ratio Y/X of the total molar amount (Y) of the terminal carboxy groups to the total molar amount (X) of the terminal amino groups in all the polyamic acids in the polyamic acid composition A1 is 0.3.

Preparation of Intermediate Transfer Belt A

A cylindrical stainless steel mold having an outer diameter of 278 mm and a length of 400 mm is prepared, and the outer surface of the mold is coated with a silicone release agent and subjected to a drying treatment (release agent treatment).

While the cylindrical mold that has undergone the release agent treatment is rotated at a speed of 10 rpm in the circumferential direction, the polyamic acid composition A1 is discharged from the end of the cylindrical mold by using a dispenser having an aperture of 1.0 mm and pressed on the mold with a constant pressure by a metal blade mounted on the mold, thereby performing coating. The dispenser unit is moved in the axis direction of the cylindrical mold at a rate of 100 mm/min, thereby coating the cylindrical mold in a spiral shape with the polyamic acid composition A1.

Thereafter, while the mold and the coated substance are rotated at 10 rpm in a drying furnace in an air atmosphere at 145° C., they are subjected to a drying treatment for 30 minutes.

A solvent is volatilized from the coated substance after drying, thereby converting the coated substance to a polyamic acid resin-molded product (member of an endless belt) having a self-supporting property.

After the drying treatment, a baking treatment is subsequently carried out in a clean oven at 300° C. for 2 hours to perform an imidization reaction. Thereafter, the temperature of the mold is set to 25° C. and the resin is detached from the mold to obtain a desired polyimide endless belt A.

An intermediate transfer belt (thickness: 80 μm) prepared by cutting both terminals of the obtained polyimide endless belt A is taken as a belt A.

The volume resistivity and the electric field dependence of the obtained belt are measured by the above-described method, and as a result, the volume resistivity and the electric field dependence of the belt A are 11.0 log Ω·cm and 0.0025 (log Ω·cm)/V in a voltage range of from 500 V to 1,000 V, respectively.

Preparation of Intermediate Transfer Belt B

The intermediate transfer belt (thickness: 80 μm) prepared in the same manner as in the preparation of the intermediate transfer belt A except that the drying treatment temperature is 160° C. is taken as a belt B.

The volume resistivity and the electric field dependence of the belt B are 10.2 log Ω·cm and 0.0040 (log Ω·cm)/V in a voltage range of from 500 V to 1,000 V, respectively.

Preparation of Intermediate Transfer Belt C

The intermediate transfer belt (thickness: 80 μm) prepared in the same manner as in the preparation of the intermediate transfer belt A except that the drying treatment temperature is 155° C. and the drying time is 40 minutes is taken as a belt C.

The volume resistivity and the electric field dependence of the belt C are 10.8 log Ω·cm and 0.0029 (log Ω·cm)/V in a voltage range of from 500 V to 1,000 V, respectively.

Preparation of Intermediate Transfer Belt D

The intermediate transfer belt (thickness: 80 μm) prepared in the same manner as in the preparation of the intermediate transfer belt A except that the drying treatment temperature is 170° C. and the baking treatment temperature is 310° C. is taken as a belt D.

The volume resistivity and the electric field dependence of the belt D are 10.0 log Ω·cm and 0.0055 (log Ω·cm)/V in a voltage range of from 500 V to 1,000 V, respectively.

Preparation of Photoreceptors

Preparation of Photoreceptor A 100 parts by weight of zinc oxide (average particle diameter: 70 nm, manufactured by Tayca Corporation, specific surface area value: 15 $m^2/g$) and 500 parts by weight of methanol are stirred and mixed, and 0.75 part by weight of KBM603 (manufactured by Shin-Etsu Chemical Co., Ltd.) as a silane coupling agent is added thereto, followed by stirring for 2 hours. Thereafter, methanol is evaporated by distillation under reduced pressure and baked at 120° C. for 3 hours to obtain zinc oxide particles surface-treated with the silane coupling agent.

60 parts by weight of the surface-treated zinc oxide particles, 1.2 parts by weight of 4-ethoxy-1,2-dihydroxy-9,10-anthraquinone as an electron accepting compound, 13.5 parts by weight of blocked isocyanate (SUMIDUR 3173, manufactured by Sumitomo Bayer Urethane Co., Ltd.) as a curing agent, and 15 parts by weight of a butyral resin (S-LEC BM-1, manufactured by Sekisui Chemical Co., Ltd.) are dissolved in 85 parts by weight of methyl ethyl ketone to prepare a mixed solution, and 38 parts by weight of the mixed solution and 25 parts by weight of methyl ethyl ketone are mixed and dispersed with a sand mill using glass beads having a diameter of 1 mm for 4 hours to obtain a dispersion. To the obtained dispersion, 0.005 part by weight of dioctyltin dilaurate as a catalyst and 4.0 parts by weight of silicone resin particles (TOSPEARL 145, manufactured by GE Toshiba Silicones Co., Ltd.) are added to obtain a coating liquid for forming an undercoat layer. The viscosity of the coating liquid for forming an undercoat layer at a coating temperature of 24° C. is 235 mPa·s.

An aluminum substrate having a diameter of 30 mm is coated with the coating liquid at a coating speed of 220 mm/min using a dip-coating method, and then dried and cured for 40 minutes at 180° C. to obtain an undercoat layer having a thickness of 23.5 μm.

Next, a mixture of 15 parts by weight of a hydroxygallium phthalocyanine crystal as a charge generating material having strong diffraction peaks at least at Bragg angles (2θ±0.2°) of 7.5°, 9.9°, 12.5°, 16.3°, 18.6°, 25.1°, and 28.3° with respect to CuKα characteristic X-rays, 10 parts by weight of a copolymer resin of vinyl chloride-vinyl acetate (VMCH, manufactured by Nippon Unicar Company Ltd.), and 300 parts by weight of n-butyl alcohol is dispersed with a sand mill using glass beads having a diameter of 1 mm for 4 hours to obtain a coating liquid for forming a charge generation layer. The viscosity of the coating liquid for forming a charge generation layer at a coating temperature of 24° C. is 1.8 mPa·s. The undercoat layer is dip-coated with this coating liquid using a dip-coating method at a coating speed of 65 mm/min, and dried at 150° C. for 7.5 minutes to obtain a charge generation layer.

Subsequently, 8 parts by weight of tetrafluoroethylene resin particles (average particle diameter: 0.2 μm) and 0.01 part by weight of a methacrylic copolymer (ARON GF400, manufactured by Toagosei Co., Ltd.) containing an alkyl fluoride group are kept at a liquid temperature of 20° C. together with 4 parts by weight of tetrahydrofuran and 1 part by weight of toluene, and are stirred and mixed for 48 hours to obtain a tetrafluoroethylene resin particle suspension A (hereinafter abbreviated as a "liquid A").

Next, 1.6 parts by weight of a compound represented by the following Structural formula 1 as a charge transport substance, 3 parts by weight of N,N'-bis(3-methylphenyl)-

N,N'-diphenylbenzidine, 6 parts by weight of a polycarbonate copolymer (viscosity average molecular weight: 45,000) including a repeating unit represented by the following Structural formula 2 and a repeating unit represented by the following Structural formula 3 as a binder resin, 0.1 parts by weight of 2,6-di-t-butyl-4-methylphenol as an antioxidant, and 0.14 parts by weight of a hindered phenol antioxidant represented by the following Structural formula 4, and 0.07 parts by weight of a benzophenone ultraviolet absorber represented by the following Structural formula 5 are mixed, 24 parts by weight of tetrahydrofuran and 11 parts by weight of toluene are mixed therewith, and the mixture is dissolved to obtain a mixed solution liquid B (hereinafter referred to as a "liquid B").

The liquid A is added to the liquid B, followed by stirring and mixing, followed by repeatedly carrying out a dispersion treatment 6 times under pressure increased to 500 kgf/cm$^2$ by the use of a high-pressure homogenizer (manufactured by Yoshida Kikai Co., Ltd.) having a penetration-type chamber having a minute channel mounted therein, and 5 ppm of ether-modified silicone oil (trade name: KP340, manufactured by Shin-Etsu Chemical Co., Ltd.) is added thereto and sufficiently stirred to obtain a coating liquid for forming a charge transport layer. The charge generation layer is coated with this coating liquid so that the thickness of the coating liquid becomes 40 μm, and dried at 145° C. for 40 minutes to form a charge transport layer, thereby obtaining a desired electrophotographic photoreceptor. The electrophotographic photoreceptor thus obtained is taken as a photoreceptor A.

(Structural Formula 1)

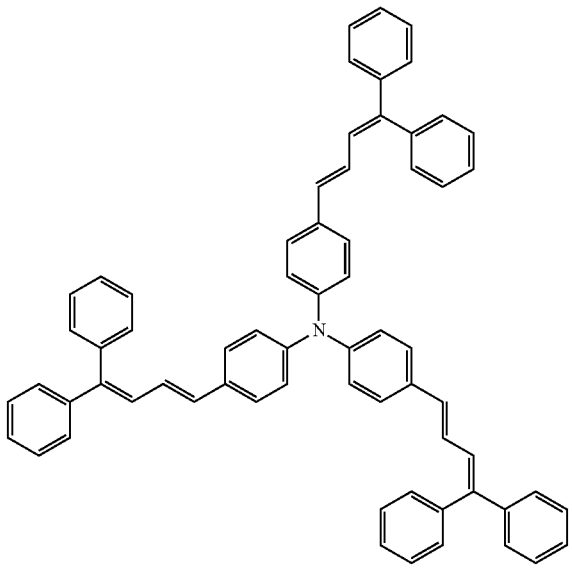

(Structural Formula 2)

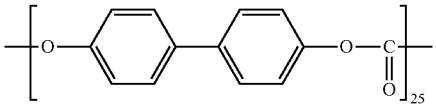

-continued (Structural Formula 3)

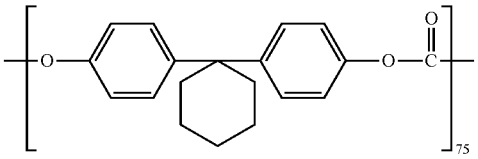

(Structural Formula 4)

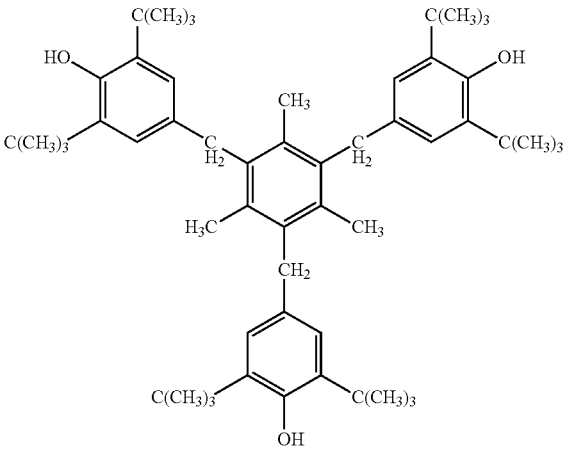

(Structural Formula 5)

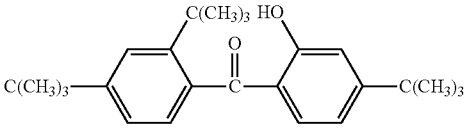

Preparation of Photoreceptor B

A photoreceptor prepared in the same manner as in the preparation of the photoreceptor A except that 4.6 parts by weight of N,N'-bis(3-methylphenyl)-N,N'-diphenylbenzidine alone is used as a charge transport material is taken as a photoreceptor B.

Preparation of Photoreceptor C

A photoreceptor prepared in the same manner as in the preparation of the photoreceptor A except that a hindered phenol antioxidant and a benzophenone ultraviolet absorber are not added to a coating liquid for forming a charge transport layer is taken as a photoreceptor C.

Preparation of Photoreceptor D

A photoreceptor prepared in the same manner as in the preparation of the photoreceptor A except that 4.6 parts by weight of N,N'-bis(3-methylphenyl)-N,N'-diphenylbenzidine alone is used as a charge transport material, and a hindered phenol antioxidant and a benzophenone ultraviolet absorber are not added to a coating liquid for forming a charge transport layer is taken as a photoreceptor D.

Preparation of Photoreceptor E

A photoreceptor prepared in the same manner as in the preparation of the photoreceptor A except that a hindered phenol antioxidant is not added to a coating liquid for forming a charge transport layer is taken as a photoreceptor E.

Preparation of Photoreceptor F

A photoreceptor prepared in the same manner as in the preparation of the photoreceptor A except that a benzophenone ultraviolet absorber is not added to a coating liquid for forming a charge transport layer is taken as a photoreceptor F.

Example 1

The intermediate transfer belt A and the photoreceptor A, each prepared as above, are mounted in a modified machine of DOCUCENTRE-IV C5575 (manufactured by Fuji Xerox Co., Ltd.) to perform image formation, and the following evaluations are carried out. The machine is modified so as to control charge erasing bias.

Evaluations

Ghosting

Ghosting is evaluated as follows: the photoreceptor and the intermediate transfer belt with respect to each of Examples and Comparative Examples are mounted in the modified machine of DOCUCENTRE-IV C5575, a 20 mm×20 mm image having an image density of 100% is output under the conditions of a high temperature and a high humidity, a half-tone image of 30% as A4 is continuously output, and the change in density of the half-tone image after one round in the photoreceptor is visually evaluated. The high temperature and the high humidity herein are ambient environments at 28° C. and 85% RH.

A: No change in density

B: Slight change in density

C: Change in density

D: Clear change in density

Transfer Failure

Transfer failure is evaluated as follows: the photoreceptor and the intermediate transfer belt with respect to each of Examples and Comparative Examples are mounted in the modified machine of DOCUCENTRE-IV C5575, a 20 mm×20 mm image having an image density of 100% is output under the conditions of a high temperature and a high humidity, and deletion in the image is visually evaluated. The high temperature and the high humidity herein are ambient environments at 28° C. and 85% RH.

A: No deletion

B: Slight deletion

C: Deletion

D: Clear deletion

Examples 2 to 6 and Comparative Examples 1 to 5

Image formation is carried out in the same manner as in Example 1 except that the photoreceptor, the intermediate transfer belt, and the toner are changed to the combinations shown in Table 1, and evaluation is carried out.

The intermediate transfer members and the photoreceptors used in the respective Examples and evaluation results thereof are shown in Table 1.

TABLE 1

| | Configuration of device | | | | | | Evaluation | |
|---|---|---|---|---|---|---|---|---|
| | | Intermediate transfer member | | | | | | |
| | Photoreceptor Type | Type | Electric field dependence of volume resistivity (logΩ · cm/V) | Charge erasing bias | Toner Particle diameter (μm) | Charge erasing device | Ghosting | Transfer failure |
| Example 1 | Photoreceptor A | Belt A | 0.0025 | 26 μA | 4.7 | No charge erasing device Transfer and charge erasing | A | B |
| Example 2 | Photoreceptor B | Belt A | 0.0025 | 26 μA | 4.7 | No charge erasing device Transfer and charge erasing | B | B |
| Example 3 | Photoreceptor A | Belt C | 0.0029 | 26 μA | 4.7 | No charge erasing device Transfer and charge erasing | B | B |
| Example 4 | Photoreceptor E | Belt A | 0.0025 | 26 μA | 4.7 | No charge erasing device Transfer and charge erasing | B | B |
| Example 5 | Photoreceptor F | Belt A | 0.0025 | 26 μA | 4.7 | No charge erasing device Transfer and charge erasing | B | B |
| Example 6 | Photoreceptor A | Belt A | 0.0025 | 22 μA | 5.8 | No charge erasing device Transfer and charge erasing | A | B |
| Comparative Example 1 | Photoreceptor C | Belt B | 0.0040 | 26 μA | 4.7 | No charge erasing device Transfer and charge erasing | C | D |
| Comparative Example 2 | Photoreceptor C | Belt D | 0.0055 | 32 μA | 4.7 | No charge erasing device Transfer and charge erasing | D | C |
| Comparative Example 3 | Photoreceptor D | Belt C | 0.0029 | 26 μA | 4.7 | No charge erasing device Transfer and charge erasing | C | C |

TABLE 1-continued

| | Configuration of device | | | | | | Evaluation | |
|---|---|---|---|---|---|---|---|---|
| | | Intermediate transfer member | | | | | | |
| | Photoreceptor Type | Type | Electric field dependence of volume resistivity (logΩ · cm/V) | Charge erasing bias | Toner Particle diameter (μm) | Charge erasing device | Ghosting | Transfer failure |
| Comparative Example 4 | Photoreceptor C | Belt D | 0.0055 | 26 μA | 5.8 | No charge erasing device Transfer and charge erasing | C | C |
| Comparative Example 5 | Photoreceptor C | Belt D | 0.0055 | 26 μA | 4.7 | Charge erasing device mounted No Transfer and charge erasing | D | D |

From the above results, it may be seen that "ghosting" and "transfer failure" in Examples are prevented, as compared with those in Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor having an electroconductive substrate and a photosensitive layer that is provided on the electroconductive substrate, the photosensitive layer comprising a hindered phenol antioxidant and a benzophenone ultraviolet absorber;

a charging device that charges a surface of the electrophotographic photoreceptor;

an electrostatic latent image forming device that forms an electrostatic latent image on a charged surface of the electrophotographic photoreceptor;

a developing device that develops the electrostatic latent image formed on the surface of the electrophotographic photoreceptor by a developer including a toner to form a toner image; and a transfer device that includes an intermediate transfer belt whose electric field dependence of a volume resistivity is 0.003 or less (log Ω·cm)/V in a voltage range of from 500 V to 1,000 V, and transfers the toner image formed on the surface of the electrophotographic photoreceptor onto a recording medium through the intermediate transfer belt and erases the charges from the surface of the electrophotographic photoreceptor by applying current to the electrophotographic photoreceptor after the toner image formed on the surface of the electrophotographic photoreceptor has been transferred onto the intermediate transfer belt and before the electrophotographic photoreceptor has been charged.

2. The image forming apparatus according to claim 1, wherein the electric field dependence of a volume resistivity of the intermediate transfer belt is from 0.0010 (log Ω·cm)/V to 0.0028 (log Ω·cm)/V in a voltage range of from 500 V to 1,000 V.

3. The image forming apparatus according to claim 1, wherein the hindered phenol antioxidant has a structure represented by the following formula (HP):

(HP)

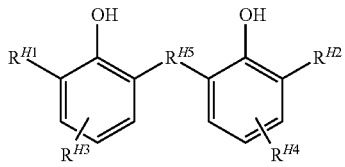

wherein $R^{H1}$ and $R^{H2}$ each independently represent a branched alkyl group having from 4 to 8 carbon atoms, $R^{H3}$ and $R^{H4}$ each independently represent a hydrogen atom or an alkyl group having from 1 to 10 carbon atoms, and $R^{H5}$ represents an alkylene group having from 1 to 10 carbon atoms.

4. The image forming apparatus according to claim 1, wherein a molecular weight of the hindered phenol antioxidant is from 300 to 1,000.

5. The image forming apparatus according to claim 1, wherein a molecular weight of the hindered phenol antioxidant is from 300 to 900.

6. The image forming apparatus according to claim 1, wherein a molecular weight of the hindered phenol antioxidant is from 300 to 800.

7. The image forming apparatus according to claim 1, wherein the benzophenone ultraviolet absorber has a structure represented by the following formula (BP):

(BP)

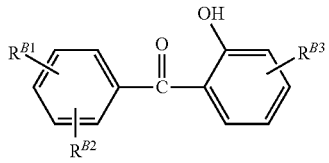

wherein $R^{B1}$, $R^{B2}$, and $R^{B3}$ each independently represent a hydrogen atom, a halogen atom, hydroxyl group, an alkyl group having from 1 to 10 carbon atoms, an alkoxy group having from 1 to 10 carbon atoms, or an aryl group having from 1 to 10 carbon atoms.

8. The image forming apparatus according to claim 7, wherein at least one of $R^{B1}$, $R^{B2}$, and $R^{B3}$ in the structure represented by formula (BP) is an alkoxy group having from 1 to 3 carbon atoms.

9. The image forming apparatus according to claim 1, wherein the electrophotographic photoreceptor has a charge generation layer and a charge transport layer containing a charge transport material represented by the following formula (CT1) as the photosensitive layer:

(CT1)

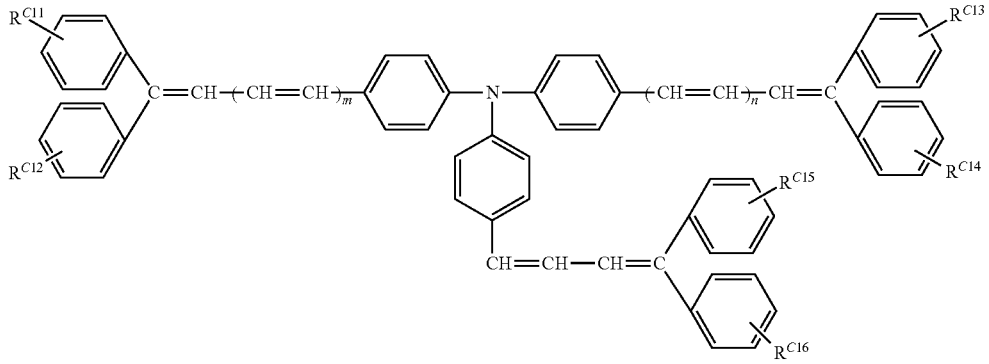

wherein $R^{C11}$, $R^{C12}$, $R^{C13}$, $R^{C14}$, $R^{C15}$, and $R^{C16}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms, and two adjacent substituents may be bonded to each other to form a hydrocarbon ring structure, and n and m each independently represent 0, 1, or 2.

10. The image forming apparatus according to claim 1, wherein a volume average particle diameter of the toner is equal to or less than 5.0 μm.

11. A process cartridge that is detachable from an image forming apparatus, comprising:

an electrophotographic photoreceptor having an electroconductive substrate and a photosensitive layer that is provided on the electroconductive substrate, the photosensitive layer comprising a hindered phenol antioxidant and a benzophenone ultraviolet absorber; and a transfer device that includes an intermediate transfer belt whose electric field dependence of the volume resistivity is 0.003 or less (log Ω·cm)/V in a voltage range of from 500 V to 1,000 V, and transfers the toner image formed on the surface of the electrophotographic photoreceptor onto a recording medium through the intermediate transfer belt and erases the charges from the surface of the electrophotographic photoreceptor by applying current to the electrophotographic photoreceptor after the toner image formed on the surface of the electrophotographic photoreceptor has been transferred onto the intermediate transfer belt and before the electrophotographic photoreceptor has been charged.

12. The process cartridge according to claim 11, wherein the electric field dependence of a volume resistivity of the intermediate transfer belt is from 0.0010 (log Ω·cm)/V to 0.0028 (log Ω·cm)/V in a voltage range of from 500 V to 1,000 V.

13. The process cartridge according to claim 11, wherein the hindered phenol antioxidant has a structure represented by the following formula (HP):

(HP)

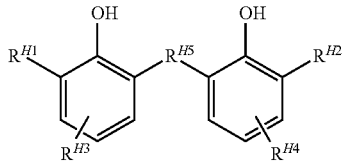

wherein $R^{H1}$ and $R^{H2}$ each independently represent a branched alkyl group having from 4 to 8 carbon atoms, $R^{H3}$ and $R^{H4}$ each independently represent a hydrogen atom or an alkyl group having from 1 to 10 carbon atoms, and $R^{H5}$ represents an alkylene group having from 1 to 10 carbon atoms.

14. The process cartridge according to claim 11, wherein a molecular weight of the hindered phenol antioxidant is from 300 to 1,000.

15. The process cartridge according to claim 11, wherein a molecular weight of the hindered phenol antioxidant is from 300 to 900.

16. The process cartridge according to claim 11, wherein a molecular weight of the hindered phenol antioxidant is from 300 to 800.

17. The process cartridge according to claim 11, wherein the benzophenone ultraviolet absorber has a structure represented by the following formula (BP):

(BP)

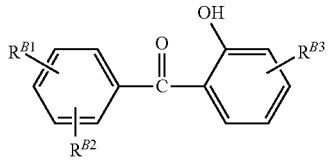

wherein $R^{B1}$, $R^{B2}$, and $R^{B3}$ each independently represent a hydrogen atom, a halogen atom, hydroxyl group, an alkyl group having from 1 to 10 carbon atoms, an alkoxy group having from 1 to 10 carbon atoms, or an aryl group having from 1 to 10 carbon atoms.

18. The process cartridge according to claim 17, wherein at least one of $R^{B1}$, $R^{B2}$, and $R^{B3}$ in the structure represented by formula (BP) is an alkoxy group having 1 to 3 carbon atoms.

19. The process cartridge according to claim 11, wherein the electrophotographic photoreceptor has a charge generation layer and a charge transport layer containing a charge transport material represented by the following formula (CT1) as the photosensitive layer:

(CT1)

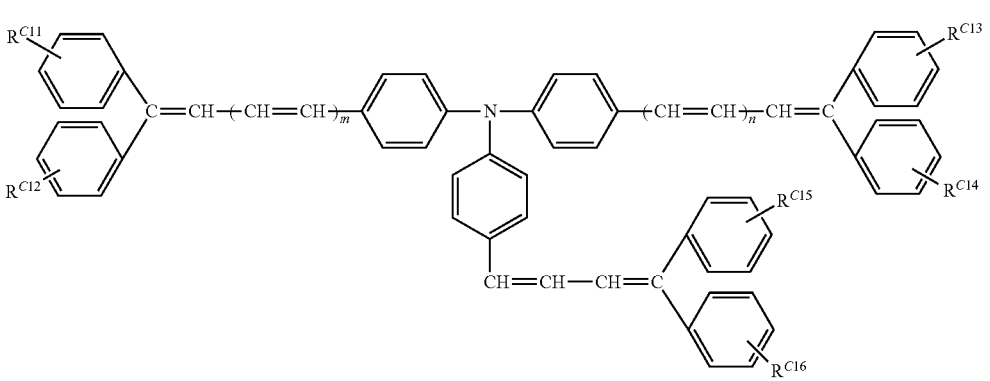

wherein $R^{C11}$, $R^{C12}$, $R^{C13}$, $R^{C14}$, $R^{C15}$, and $R^{C16}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms, and two adjacent substituents may be bonded to each other to form a hydrocarbon ring structure, and n and m each independently represent 0, 1, or 2.

* * * * *